US008789591B2

(12) United States Patent
Smith

(10) Patent No.: US 8,789,591 B2
(45) Date of Patent: Jul. 29, 2014

(54) METHOD AND APPARATUS TO RELEASE ENERGY IN A WELL

(76) Inventor: David R. Smith, Midland, TX (US)

( * ) Notice: Subject to any disclaimer, the term of this patent is extended or adjusted under 35 U.S.C. 154(b) by 502 days.

(21) Appl. No.: 13/028,883

(22) Filed: Feb. 16, 2011

(65) Prior Publication Data

US 2011/0209869 A1 Sep. 1, 2011

Related U.S. Application Data

(60) Provisional application No. 61/304,905, filed on Feb. 16, 2010.

(51) Int. Cl.
*E21B 7/14* (2006.01)
*E21B 43/24* (2006.01)
*E21B 36/00* (2006.01)

(52) U.S. Cl.
CPC . *E21B 43/24* (2013.01); *E21B 7/14* (2013.01); *E21B 36/008* (2013.01)
USPC ..... 166/260; 166/261; 166/302; 166/59

(58) Field of Classification Search
CPC ..... E21B 7/14; E21B 43/24; E21B 36/008
USPC ..... 175/11, 12, 14; 166/256, 260, 77.2, 59, 166/300, 302
See application file for complete search history.

(56) References Cited

U.S. PATENT DOCUMENTS 2,738,162 A * 3/1956 Aitchison ..... 175/14
3,376,932 A * 4/1968 Hunt ..... 166/59
3,497,000 A * 2/1970 Hujsak et al. ..... 166/59
3,744,579 A * 7/1973 Godfrey ..... 175/67
3,746,088 A * 7/1973 Haskin et al. ..... 166/59
3,835,937 A * 9/1974 Hokao et al. ..... 175/6
4,073,351 A * 2/1978 Baum ..... 175/14
5,135,052 A 8/1992 Puerto
5,771,984 A * 6/1998 Potter et al. ..... 175/14
7,971,658 B2 * 7/2011 Buckman, Sr. ..... 175/67
8,020,622 B2 * 9/2011 Richard ..... 166/302
2008/0017372 A1 1/2008 Gates et al.
2009/0133788 A1 5/2009 Mungas et al.
2009/0308613 A1 12/2009 Smith
2010/0089577 A1 * 4/2010 Wideman et al. ..... 166/272.6
2011/0303460 A1 * 12/2011 Von Rohr et al. ..... 175/14

FOREIGN PATENT DOCUMENTS

WO WO-2006/014548 A2 2/2006
WO WO-2006/063200 A2 6/2006

OTHER PUBLICATIONS

International Preliminary Report on Patentability in foreign proceedings of PCT/US2011/025083 dated Aug. 21, 2012.
International Search Report and Written Opinion from corresponding PCT/US2011/025083.

* cited by examiner

*Primary Examiner* — Kenneth L Thompson
(74) *Attorney, Agent, or Firm* — Fulbright & Jaworski LLP

(57) ABSTRACT

The present invention is directed towards methods and apparatus to release energy into wells using combustion of monopropellants. More specifically, this invention is directed to industrial methods to enhance the extraction of well fluids from wells by using the in-situ energy released from this inventions apparatus, methods, catalyst, and fluids blends for subterranean catalytic combustion of monopropellants.

27 Claims, 7 Drawing Sheets

METHOD AND APPARATUS TO RELEASE ENERGY IN A WELL

CROSS-REFERENCE TO RELATED APPLICATIONS

This application claims priority to U.S. provisional patent application Ser. No. 61/304,905, filed Feb. 16, 2010.

TECHNICAL FIELD

The present invention is directed to methods and apparatus to increase oil and gas production from wells by injecting hot fluids into wells and subterranean reservoirs. More specifically, this invention teaches methods of fluid injection combined with apparatus and methods to catalytically combust monopropellants for the industrial purpose of increasing oil and gas recovery from wells. The methods and apparatus herein disclosed improve current oil and gas recovery practices in the fields of artificial lift, stimulation, flooding, enhanced oil recovery, flow assurance, drilling, well completions, subterranean well logging, and permanent subterranean well monitoring, and mineral extractions from subterranean depths.

BACKGROUND OF THE INVENTION

One goal of the present invention is to mitigate and/or obviate the disadvantages of the conventional energy delivery methods to subterranean environments to assist hydrocarbon production from same. These conventional methods include the current fields of steam floods, hot oil treatments, down hole combustion, fire floods, electrical heaters, and other hot fluid injection methods known to those familiar to the art of oil and gas production. The special class of monopropellants used by this invention are mixed and prepared at surface and thereafter transmitted to subterranean depths and in some cases to sub-sea depths in marine hydrocarbon recovery applications. This invention has advantages over the injection and catalytic combustion and catalytic decomposition of hydrogen peroxide, hydrazine, Otto Fuel, monopropellant blends, and other oxygenated fuel systems used to combust or decompose and inject heat into wells and subterranean reservoirs. The invention includes methods and apparatuses to transmit, combust, inject, control the energy released therefrom, and transfer heat from chemicals combusted in catalytic devices for the industrial purpose of enhancing oil and gas production from wells. Furthermore, the invention includes methods and apparatuses to, at least partially, transform fluid systems to their supercritical state by blending various fluid systems and using this described methods devices to transfer energy to these fluids systems to reach temperature and pressure that places them, or at least some components of them, in a thermodynamic state of a supercritical fluid.

When constructing a well bore in the earth and thereafter extracting well fluids, the ability to transmit heat down into the earth in the limited space of a typical well bore is of extreme economic interest. This heat is used to mobilize subterranean reservoir fluids from the earth, melt and maintain flow in well conduits and flow lines, and assist in artificially lifting fluids from wells. Monopropellant fluids that store large amounts of energy such that chemical reactions such as combustion, catalytic decomposition, offer a means to release large amounts of heat in a well using submersible catalytic combustor methods combined with novel submersible apparatus.

This need for transporting and releasing large amounts of energy from the surface to a subterranean environment arises firstly in the actual construction of the well bore where energy generated at surface is required to turn the drill bit located significant distances from the surface of the earth. This drilling phase of construction normally requires a drill stem of pipe to be disposed in the well with a drilling bit on the distal end of the drill stem. Typically, energy is transmitted using hydraulic power through the drill stem to the drill bit by the rotation of the drill string from a surface device commonly referred to as the drilling rig rotary table. The surface rotary table of the rig engages the drill stem at the proximal, or surface end, of the drill stem, and turns the entire drill stem imparting torque to through the drill stems total length thereby transmitting the surface power to the down hole drill bit on the distal end of the drill stem. This is commonly referred to as rotary drilling by those familiar with the art of well drilling.

The current rotary drilling method loses a significant portion of the energy imparted at the surface of the drill stem before the energy can be used at the drill bit to make the well bore. This energy is lost in drag of the rotating drill stem in the well bore. Moreover, as wellbores are constructed with inclined or deviated directions as is now increasingly common in what is known as horizontal wells, the drag and torque induced by the friction of the drill pipe turning inside these deviated well bores further increases energy losses transmitted from surface to the down hole drilling bit. To overcome this large drag and loss of energy between the drill bit and the surface rotary table of the rig, methods of hydraulic drilling motors have been developed. These hydraulic drilling motors also are powered by surface energy, typically large pumps referred to by those familiar with the art of well drilling as mud pumps. These surface mud pumps then transmit large volumes of high pressure mud through the drill stem to the down hole drilling motor, which in turn is connected to the drill bit and thusly rotates the drill bit. This method avoids the large drag and frictional losses of classical rotary drilling, but it too has energy losses between the surface and the down hole bit as well, wherein the high pressure drilling mud fluid being pumped down the drill string to power the drilling motor experiences fluid friction as it is being pumped down to the drilling hydraulic motor on the distal (i.e., downhole) end of the drill stem connected to a drilling bit. Therefore, the deeper or longer the well, the more fluid friction in the drill stem is increased. It then becomes incumbent on the driller to run larger drill stem pipe or increase the surface horsepower to pump at ever higher pressures the drilling mud to the down hole drilling motor. What is needed is the ability to transmit power to the subterranean drill strings with less losses than is currently incurred with rotary or down hydraulic motor drilling methods.

Further use of drilling is required during the life of the well, for example during the drilling out of frac plugs, or cement plugs, again requiring a rig or large surface hydraulic pumps to power the down hole drilling motor that subsequently rotates the drill bit. Drilling is currently performed by the mechanical action of milling of the material at the distal end of the drill pipe with a drilling bit. This has the deleterious effect of wearing out the drill bit over time, and the subsequent removal of the drill stem from great depths to replace the drill bit. The current drilling methods all teach away from using heat to improve the drilling operations. The literature discuss in great detail the delirious effects of heat on drilling bits, drilling motors, and down hole drilling logging tools. The methods of the present invention use the advantageous use of heat for drilling, particularly in the field of drilling out plugs placed in horizontal wells between frac stages. This addresses the current need for a method to remove material from well bores that is not restricted to the milling and abrasive methods of the current state of the art in well drilling. What is currently needed in the art to this point, is a method and apparatus to drill out frac plugs, bridge plugs, and other down hole equipment designed to be removed with heat such that these plugs can be removed with chemical heating methods and apparatus of my invention where heat is used to enhance the removal of said plugs.

There exist other industrial processes that make use of energy in subterranean environments. Many of these processes are designed to specifically to transfer heat to a down hole reservoirs or well bore. It is of great economic interest to heat down hole environments to mobilize and enhance the production of subterranean fluids in both the fields of secondary and tertiary recover flooding methods and in the field of well stimulation.

The use of injecting heated fluids into wells and reservoirs has been practiced for many years to remove solid substances such as paraffin, hydrates, asphaltenes, diamondoids, and waxes from oil and gas well flow production tubing, wellheads, subsea flow lines, and surface flow lines. Today this is commonly done by heating oil or other fluids at surface in what is known in the oil and gas industry as a "hot oil trucks" wherein the pumping of hot oil through a surface propane heater mounted on the "hot oiler truck" is then pumped down through a well conduit, into the reservoir. The current industry methods are directed toward injecting the heated fluids that melt these substances firstly down the plugged tubular, and then secondly into the reservoir. This hot oil method currently used then melts waxes, paraffin, asphaltenes, diamondoids, gas hydrates, and other substances that have accumulated in production conduits, like production tubing, well heads, and flow lines at the surface of the earth and in subsea flow lines. These methods of melting these substances by pumping hot oil and dissolving them in the hot oil re-injects this hot oil with these now melted substances back into the well reservoir. The current methods of injecting the hot oil treatment fluids back into the reservoir result in the deleterious effect that these substances now melted, fluidized, and transported into the subterranean reservoir can cause plugging in the reservoir. Moreover, the current methods of reinjection of these melt materials with hot oil results these same melted solids that were fluidized back into the reservoir being eventually produced back up the well conduit, wellhead, and flow lines where they once again cool off and precipitate hence they are an impediment to flow of oil and gas from the reservoir to the surface. This hot oil method and other fluid heating methods currently practiced by the industry has to be repeated more and more frequently as the waxes and other substances after being dissolved and injected back into the reservoir tend to have shorter and shorter time intervals between the time the well can produce fluid until it plugs with these substances. In offshore applications, a field of study has been developed within the offshore industry, known to those involved in the industry of producing oil and gas offshore, as flow assurance. What is needed is a means to heat and melt these substances that plug well tubulars, wellheads, and flow lines and indeed to prevent them from occurring. My invention teaches methods and apparatus that do not require the injection into the reservoir of the hot fluid with the melted substances but conversely offers a means to produce these melted substance in the heated fluid to surface without injecting them into the reservoir. The invention described herein combines the solvency power of the heated fluid of catalytic combustion with the a method of allowing the exhaust gases of the catalytic combustion to lift the melted substance to surface without being re-injected in the reservoir.

Additionally, the ability to enhance oil and gas production by heating the subterranean reservoir or the reservoir fluids in the subterranean environment encompasses a broad field in the oil and gas industry known as Enhanced Oil Recovery, EOR. The methods of EOR are used to recover increased reserves of light crude oil, heavy oil, and tar sand. Indeed vast reserves of shale oil, known to those familiar with the art of hydrocarbon extraction as kerogen, exist in North America and other locals where no commercial process or industrial method has been discovered to recover kerogen and other organic matter locked in the rock structures. In the Green River Basin of Colorado and Wyoming the actual reservoir fluid is referred to as "shale oil" but is actually kerogen. This fluid is highly immobile in the natural subterranean strata. The mining of the shale and surface retorting to recover the kerogen have significant delirious cost and environmental effects. The key to the recovery of such reserves is the commercial application of subterranean heat to mobilize the kerogen.

The current art of Enhanced Oil Recovery, EOR and SAGD is directed toward the use steam heated on the surface of the earth, or electrical heating elements disposed in the earth, to recover oil shale, otherwise known as kerogen. deposits and reserves of the United States of America. The current methods teach towards generating heat or electrical power at the surface of the earth. Some method use heating elements to heat a subterranean environment which removes the combustion of hydrocarbons necessary to generate the electrical power and the subsequent down heat from the well site to a central electrical power plant where hydrocarbons are combusted to generate electrical power. Injecting surface created steam suffers from massive losses of heat to the earth as it is transported to the well and down the well, and little of the heat generated affects the reservoir and subterranean fluids of interest. What is needed is a means to create hot fluids in-situ as opposed to the means currently taught of creating hot fluids at surface and or using surface combustion of hydrocarbons to generate electrical power used for down hole heaters.

The current art of secondary or enhanced oil recovery is directed toward methods that consume vast amounts of fresh water. Those skilled in the art of EOR, inject hot fluids to transfer the heat with fluids out into the subterranean reservoir away from the well bore to mobilize and increase the hydrocarbon production. This is often done with steam generated at surface in large central steam plants and the piped along the surface to injection wells. The use of steam to mobilize in-situ hydrocarbons requires vast amounts of fresh water. Many places on the earth have a shortage of low cost fresh water, and the use of fresh potable water for the recovery of hydrocarbons compete with society's basic need for fresh water for both personal and agricultural use. In Southern California, for example, it is estimated that it takes nine barrels of fresh water to produce one barrel of crude oil in the steam flood operations. Moreover, most electrical power in the United States is generated with by burning coal or natural gas creating steam from fresh water and thereafter used in the classical Rankin Cycle to turn steam turbines and electrical generators. Therefore, electrical power plants systems used to generate electrical power which is in turn used to heat subterranean reservoirs with electrical heaters further consumes valuable fresh water as all those familiar to the art of steam generation know that the water used to make steam must be fresh water. Therefore, the current state of the art EOR methods involve the use of massive amounts of fresh water being consumed at surface to recover oil, bitumen, tar, condensates, and kerogen. Thereafter, the fresh water steam is inject into the subterranean reservoir environment in what is known to those familiar with the art as "steam flooding" or a special case of steam flooding well known to those in the Canadian Athabasca tar sands as Steam Assisted Gravity Drainage or SAGD. In either method the steam mixes with the fluid in the subterranean environment and becomes unfit for human consumption and in many cases unfit for re-use as fresh water to generate more steam for the flood. The current EOR methods thusly take fresh water from the surface of the earth and contaminate it with down hole fluids and solids where it becomes un-fit for human or agricultural use. What is needed is a means to recover hydrocarbons in the secondary and tertiary recovery phases, often referred to as EOR that includes a reduction of the fresh water contamination and consumption as compared to currently used methods.

The current methods of creating steam at the surface of the earth typically comprise combustion of significant amounts of hydrocarbon fuels on the surface of the earth. For example, in Southern California oil fields of Kern County and the Athabasca tar sands of Canada and other locals where steam flooding and SAGD methods are practiced, natural gas is combusted in massive surface boilers to create steam. The combustion of the natural gas on the surface emits carbon dioxide and nitrogen oxides into the atmosphere, such that in order to recover subterranean hydrocarbons surface combustion of hydrocarbons is taught having the delirious result of releasing combustion gases to the atmosphere. What is needed is a means to practice enhanced oil recovery such that the energy used in the process does not emit combustion gases at the steam plant or at an electrical power generation plant but conversely releases and advantageously uses combustions gases below the surface of the earth.

The current methods of using steam for enhanced oil recovery involve the generation of steam at surface. Creating steam at the surface of the earth and transporting it to subterranean depths is challenged by the loss of heat to the earth's overburden strata thusly reducing the heat that can be injected into the subterranean hydrocarbon reservoir to enhance oil recovery. Steam floods below 3,000 feet are uncommon and in most places uneconomical due to the heat losses during transportation and injection over such distances. Steam floods below 5,000 feet are usually not attempted as very little heat from surface generated steam can be injected into the 5,000 feet or greater depths. What is needed are methods to create heat at subterranean depths. This invention teaches means to combust a portion of the reservoir fluids as an in-situ fuel which is indeed the crude oil, condensate, kerogen, tar, natural gases and other in-site hydrocarbons which are to be produced to surface and commercialized. The invention described herein includes methods and apparatus to combust some portion of the hydrocarbon fluid in the reservoir as a fuel to generate down hole heat.

Fire floods or in-situ combustion has been attempted and in some reservoirs. The current art includes the use of igniting the in-situ hydrocarbon as a fuel by delivering oxygen from surface in the form of oxygen gas, liquid oxygen, compressed air, or liquid air. However, the current methods which have also included the use of air injection or oxygen injection cannot feasibly be used in a large number of reservoirs as the remaining hydrocarbons or kerogen will not sustain combustion or self ignite. What is needed is a means to initiate and sustain down hole combustion using either or the in-situ hydrocarbon for fuel or fuels from surface. To accomplish this combustion, a method is needed to ignite this in-situ fuel with a non-toxic, non-corrosive, igniter method, and thereafter sustain combustion with an oxidizer from the surface.

The ignition and sustained burn of this in-situ fuel to thereby heat the reservoir and reservoir fluids and mobilize the hydrocarbon fluids is non-trivial and non-obvious as hundreds of millions of research dollars have been spent over many decades by various large billion dollar companies without successful commercialization of shale oil such as that found in Colorado and Wyoming. The currently unrecoverable hydrocarbon reservoirs are so vast and the discovery of economical means to recover this vast wealth is so large that some companies have expended significant efforts to this end. The invention described herein discloses new methods and apparatuses to ignite and sustain in-situ combustion and reservoir heating using novel catalytic combustion heating methods.

Current methods and apparatus known to the oil and gas industry are primarily directed toward igniting fluids in-situ including the reservoir, hydrocarbons. They employ technologies that are significantly different from the present invention in that they are directed toward injecting air or oxygen and using catalytic combustion products to ignite reservoir fluids. The present invention is directed toward heating with catalytic combustion products non-oxygenated fluids to enhance hydrocarbon recovery by raising fluids to their supercritical thermodynamic state as they injected and flowed through a reservoir. One embodiment of the present invention is directed toward using catalytic decomposition and combustion products to heat non-oxygenated surface injected such that said fluids enter reservoirs above their respective super critical pressure and temperature and thusly be in the supercritical fluid phase in the hydrocarbon reservoir. For example of current methods teaching to combust in-situ reservoir fluids, the methods of Pfeffferle in U.S. Pat. No. 7,874,350 supplies oxygen or air to be ignited by a down hole catalytic combustion device to enhance reservoir fluid combustion in a well. Secondary and tertiary oil and gas recovery injection fluids can be enhanced with the heat energy release methods and apparatus enabled by my invention. Several of my invention embodiments use catalytic combustion to create supercritical fluids in wells. These embodiments do not require the combustion of the very hydrocarbon one is attempting to produce to surface.

Disclosed herein are new methods and apparatuses to allow for fluids to be used as supercritical flood and stimulation fluids whilst not combusting in-situ hydrocarbons to enhance oil and gas recovery from conventional oil and gas reservoirs, and unconventional subterranean strata and deposits such as oil shale, kerogen deposits, coal bed methane, diatom deposits, tar deposits, bitumen deposits as well as enhanced extraction methods to recover subterranean minerals through wells using the injection of super critical fluids as solvents in subterranean strata. For example, fluid solvents such as fresh water, natural gas, carbon dioxide, ammonia, propane, pentane, hexane, acids, and many other fluids enhance their ability to dissolve organic compounds and mineral deposits using my inventions methods of creating supercritical fluids which are injected into reservoirs at or above their super-critical state conditions. However, the industry teaches away from using fluids other than $CO_2$ as supercritical solvent recovery or flooding methods as other fluids require a much harsher thermodynamic conditions than does $CO_2$ to reach the supercritical state, or these other fluids with low super critical temperatures exist as gases at surface ambient conditions making it difficult to compress and pump into wells. For example my invention enables the use of ammonia as a supercritical fluid for enhanced oil and gas recovery methods as well as fracture stimulation and matrix reservoir injection stimulation. Supercritical fluids have many advantages over gases or liquids not held at or above their supercritical state in the field of secondary and tertiary oil and gas recovery as well as in-situ leaching of minerals and elements, as a fluid in a supercritical state has near zero surface tension, vastly improved solvency capacity, high diffusivity, high mass transfer, and very low viscosities. Moreover, supercritical fluids solvency power can be further enhanced by blending into them a family of micro-emulsions often referred to as micelle solutions. By using this inventions methods of subterranean in-situ heating new super-critical fluids and blends never before used for enhanced oil and gas recovery can be designed and used at their super critical state in wells allowing them to be injected into subterranean strata as super critical fluids. Super critical fluids enhance a fluids solvency ability, their ability to improve the sweep efficiency of the strata, and thereby enhance the recovery of hydrocarbon or minerals from wells.

Turning to the case of ammonia as a supercritical fluid for oil and gas recovery is illustrative of how the present invention enables the use of a new EOR fluid that to recover increased amounts of oil and gas from reservoirs. $CO_2$ has been very successfully used as a solvent flood fluid by oil and gas companies. These companies have purchased mature and non-commercial oil fields that have had through primary production and secondary water floods recovered 20-30% of their oil and gas in place. Rather than abandon the wells they discovered that the use of supercritical fluids could vastly improve the oil that could be recovered from these mature water flood fields. The industry has focused on the use of $CO_2$ as a supercritical fluid largely because $CO_2$ reaches the supercritical state under relatively mild conditions; it only needs to reach a temperature of approximately 88° F. (degrees Fahrenheit) and a pressure of approximately 1070 psi to become a supercritical fluid. To those familiar with the art of oil and gas production it is known that many oil reservoirs exist at geothermal temperatures above 88° F. Indeed, the geothermal gradient in most the world such that this supercritical temperature for $CO_2$ is reached at less than 1000 feet. Also, the ability to inject $CO_2$ above the supercritical point requires that the reservoir into which the $CO_2$ is being injected should allow injection pressure in the reservoir to sustain pressures above the supercritical pressure of $CO_2$ of approximately 1070 psi. It is well known to those familiar to oil and gas production that most reservoirs below 1000 ft have a fracture pressure above 1000 psi, hence the reservoirs can withstand $CO_2$ injected at or above super critical conditions of 88° F. and 1070 psi. Water on the other hand has to be injected at approximately 705° F. and 3200 psi. There are approximately less than 1% of the world's oil and gas reservoirs that have a geothermal temperature at or above 705° F. Therefore, water is not a convenient supercritical fluid as it requires a vast amount of energy to reach its supercritical state. Ammonia on the other hand does not need to be heated as high as water to become supercritical.

Ammonia can be injected as a supercritical fluid at approximately 270° F. and approximately 1643 psi. Therefore, what is needed to make ammonia an interesting alternative or indeed used as an alternating fluid with $CO_2$ floods is the ability to increase the down hole injection temperature of ammonia to at least 270° F. The present invention provides this possibility by using a method of in-situ catalytic combustion of a monopropellant heater for the injected ammonia. Mature oil and gas fields are only feasibly available for supercritical fluid floods currently if and only if they are near a $CO_2$ source or a $CO_2$ pipeline. $CO_2$ for flooding oil reservoirs is difficult to obtain, and is limited to those reservoirs that can access or build large pipelines from $CO_2$ sources to the mature oil and gas fields they wish to flood. Because of the super solvency of $CO_2$ as a super critical fluid pipelines have been built from as far away as Utah to mature oil fields in West Texas and great increases in oil production have been recorded over the classic non-supercritical fluid floods with water. Ammonia as a supercritical flood fluid. Ammonia has a vast network of pipelines running across, many parts of North America, Canada, and other parts of the world near or through oil fields. These pipeline systems that cover a vast portion of the U.S. are currently not near $CO_2$ pipelines. Hence the present invention has the potential of enabling the recovery of vast new reserves of oil and gas in America and Canada by opening up these areas to take advantage of the ammonia pipeline networks and use new supercritical fluid as a flood fluid, namely ammonia Moreover, my invention teaches the use of ammonia in conjunction with other super critical solvent flood fluids, like $CO_2$, propane and water.

The oil and gas industry has only been able to use natural gas, flue gases, and $CO_2$ as supercritical flood fluids. The invention now teaches how to enable ammonia as a supercritical fluid for well stimulation and enhanced oil recovery. Additionally, the present invention provides methods and apparatus to make water a supercritical fluid for such use as stimulation, hydraulic fracturing, and enhanced oil and gas recovery. Water is an available flood fluid in many areas of the world, but it has to be raised to a temperature of 705° F. and simultaneously a pressure of 3200 psi. Moreover, the present invention now allows ammonia to be heated to supercritical fluid temperatures for downhole use. However, the inventor has discovered that the supercritical temperature of water can be lowered by blending in other fluids prior to heating like ammonia. For example, by adding 50% ammonia by mass fraction to water the blended fluid only needs to be raised to a temperature of approximately 529° F. as opposed to waters supercritical temperature of approximately 705 degrees Fahrenheit. Other fluids can be blend with water to lower the blends' supercritical temperatures. However, my invention teaches means to not only increase the geographical areas now available to these new supercritical flood fluids, but my invention also greatly extends the depths to which supercritical fluids can be injected and used as my invention heats the injected fluids in-situ such that heat is not lost over long deep distance of injection from surface heat sources. For example, it is well known that steam floods can only be performed within in the field of commercial applications at depths shallower than 3,000 feet as current steam flood technology teaches toward steam generation at surface and then injection down hole. My inventions method of heating flood fluids at the down hole depths eliminates the heat loss current technology steam flood methods where the steam has to be transported from surface down hole for the commercial purpose of increasing the recovery of oil, gas, tar, condensate, bitumen, kerogen.

It is understood that one embodiment of my invention teaches toward the use of these new supercritical fluids in oil and gas flood projects wherein an injection well is used to inject the supercritical fluid into a subterranean reservoir and the fluid proceeds out into the reservoir and mobilizes reservoir fluids which are recovered in separate production wells and produced to surface. However, my invention further teaches that a well can be used as an injection well, and then after the injection of my inventions supercritical fluid the same well can be used to produce newly mobilize hydrocarbon fluids from the reservoir and well to surface. This is known as a huff and puff oil and gas recovery method enhanced with my inventions ability to convert new a novel fluids into supercritical fluids for reservoir injection.

It is understood by those familiar with oil and gas production that my inventions method of heating fluids to at least their supercritical temperatures, and pressurizing them above their supercritical pressure whilst maintaining the supercritical temperature, and injecting these supercritical fluids into reservoirs is not limited to the field of flooding wells. My invention also teaches heating methods for stimulating wells with injections on an intervention basis, known to those in the oil and gas industry as the field of matrix stimulation and fracture stimulation. It is further understood by those familiar with the art of mineral extraction that my well construction and fluid injection methods and apparatus taught herein allow for minerals to be extract through wells from great depths both on land and offshore using supercritical fluids heated and pressurized with my invention. Because the supercritical fluid methods of my invention enable offshore subterranean minerals mining besides oil and gas mining, this invention enables vast new areas of the earth to be exploited for minerals never before possible. Those familiar with lixiviant fluids being used for in-situ mineral extraction will understand how my invention enables supercritical fluids to be used as an extraction method for offshore subterranean mineral extraction.

It is also recognized by those familiar with the art of enhanced oil and gas that a given reservoir and the fluids therein may have their sweep and recovery efficiency enhanced by adding micro-emulsion surfactant technology to these new super critical fluids, and that the flood can be enhanced by changing the supercritical fluid injected from time to time. That is one can start a flood on supercritical water, then phase in stages of supercritical ammonia, followed by stages of supercritical propane, followed by a stage of supercritical $CO_2$, depending on the reservoir and in-situ hydrocarbon characteristics. It is further recognized that these staged fluids may contain different blends of micro-emulsions and diverter additives to further enhance the sweep efficiency of the flood.

This invention further teaches that the supercritical fluids that are injected are in many cases separated and recovered from the produced reservoir fluids and minerals. Therefore, the new fluid required during a flood project may reduced by re-cycling the supercritical fluid by means producing it to surface, and separating it from the produced fluids. This separation can be performed with distillation, refrigeration, gravity separation, heat, bubble towers, and other separation methods.

The oil and gas industry often needs to add energy to well environments to remove fluids from the wells. This can be done with several means known to those familiar with the art of artificial lift including gas lift means, and submersible pumping means. However, the current methods are often uneconomical in deep gas wells where the cost of deploying and operating the industries current hydraulic, mechanical, and electrical submersible devices is not commercial. What is needed is a method to transmit into a well hydraulically a chemical fluid that can be combusted in a controlled manner in-situ such that the released energy of combustion can be converted to work through various devices and machines. Furthermore, it is useful that such a fluid have combustion products that are not corrosive to the well conduits. In order to combust in-situ a fluid needs a fuel and an oxidizer. Therefore, this invention uses monopropellant fluids that contain both.

What is needed are new methods and apparatus that allow for the controlled catalytic combustion of fluids in subterranean wells to enhance the production of hydrocarbons, kerogen, tar, bitumen, and minerals from subterranean depths.

BRIEF SUMMARY OF THE INVENTION

The present invention is directed to new methods and apparatus to release energy in subterranean environments to enable the recovery of hydrocarbons and minerals. More specifically, this invention teaches methods and apparatus to release and use chemical energy in wells created by catalytically combusting a monopropellant. This invention further teaches the heating of deoxygenated fluids injected into subterranean reservoirs from surface with products produced from this inventions catalytic combustion of monopropellants methods to their supercritical thermodynamic state for the industrial purpose of increasing the surface recovery and commercialization of the desired subterranean resources.

In one embodiment of the present invention, there is a method of igniting subterranean reservoirs comprising: (a) constructing a well in the earth a wellbore having a first conduit inserted inside the wellbore, the first conduit forming a fluid path from a location at or above surface through the first conduit to at least one subterranean depth; (b) inserting a second conduit inside the first conduit with a proximal end of the second at the surface and a distal end of the second conduit inside the wellbore; (c) inserting at least one monopropellant conduit with the proximal end at surface and distal end located in the well; (d) connecting at least one reaction chamber to the well conduit wherein a catalyst structure is contained; (e) transmitting a monopropellant from surface through a well conduit, through a catalyst, reaction chamber, catalytically combusting the monopropellant releasing energy and, (d) using this energy in the well to enhance fluid production from the subterranean environment.

In other embodiments, the method further comprises the steps of moving reaction chambers in a wellbore whilst the monopropellants are being injected from surface and being combusted in the catalytic reaction chamber. This embodiment teaches the connection of at least one reaction chamber to a conduit having the distal end of coiled tubing at surface and engaged with a surface injector head with said coiled or continuous tube while injecting the monopropellant through the coiled tubing from surface, transmitting the fluid through the coiled tubing in the well, through the reaction chamber, contacting at least one catalyst therein, thereby heating different portions of the well bore as the reaction chamber exhausting the combustion products is simultaneously translated through the well. This embodiment can be practiced to remove scale, paraffin, hydrates, as well as form weldments, melt plugs, bake earthen well bore walls, perforate wells, and cure resins and epoxies in the well.

Another embodiment, uses the same method of transmitting monopropellant fluids through coiled tubing as disclosed above but in this case fluids from surface are pumped down other well conduits, for example down the production tubing, coiled tubing, capillary tubing, or casing, and mixing with the combustion products coming from the reaction chambers and the combined mixed fluid stream is injected into the subterranean reservoirs. These surface fluids being pumped down the well to be mixed with this inventions catalytic combustion products can be surfactants, solvents, air, water, ammonia, carbon dioxide, acids, bases, peroxides, solids, other propellants, and blends thereof. In one embodiment the injected fluid from surface is a de-oxygenated fluid that can obtain super critical conditions as the fluid is heated and pressurize during the injection and mixing process. This method further includes the use of certain fluid blends with water to lower the pressure required for water to be injected into reservoirs at supercritical conditions. For example, the injection of water into a reservoir at super critical conditions would require a water temperature to be above approximately 705° F. and approximately 3200 psi. Further embodiments include methods and apparatus to heat the water to super critical temperatures. However, many reservoirs cannot sustain injection pressures of 3200 psi. required for water to be a supercritical fluid. For example, fracture pressures gradients of rock and reservoirs are in many places in the oil and gas industry approximately 0.6 psi/ft. Therefore a 5,000 ft reservoir would begin to fracture at 3000 psi and not allow the fluid to be injected at or above as 3,000 psi. Therefore, the super critical water conditions of 3200 psi could not be reached nor sustained at these depths and conditions. However, by pumping liquid ammonia at 30% mass fraction with water super critical pressures for the blend of water and ammonia can be reached at approximately 2946 psi 54 psi below the reservoirs fracture pressure. The temperature for the water with a 30% mass fraction of ammonia blend will be reduced from water's super's critical temperature of 705 Fahrenheit the ammonia and water blend to 602° F. By increasing the ammonia concentrations water can be injected at lower and lower pressures and the ammonia water blend will remain a super critical fluid if and only if the blends super critical temperature can be simultaneously maintained. The present invention allows for fluids to be heated down hole and thereby allow deep reservoirs, for example below 5,000 feet to be stimulated and flooded with supercritical fluids.

In another embodiment of the present invention, there is the heating of fluids below the surface to supercritical states to enhance oil and gas recovery can be demonstrated by considering the example of very deep reservoirs off shore, like those that exist in the Gulf of Mexico or offshore Brazil. The injection of water into these deep reservoirs for pressure maintenance or secondary and territory recovery has hereto forthwith been considered non-commercial. Even though the geothermal temperatures of deep 30,000 feet wells in the Gulf of Mexico can reach 590° F. this remains well below waters supercritical temperature of approximately 705° F. Many reservoirs have hydrocarbon fluids that will increase in viscosity, precipitate substances like diamondoids, paraffin, asphaltenes, and gas hydrates that have the delirious effect of plugging production tubing, subsea wellheads, subsea flow lines, and riser conduits connecting the wells reservoir to the surface. Various embodiments of the present invention include methods to assure that the flow is not inhibited by these blockage mechanisms. Many deep water wells have sub-sea well heads that have sub-sea flow lines and pipelines located at great water depths, from 1,000 ft to 15,000 feet. At these deep water depths the ocean temperatures are low, approaching 35° F. Hence any produced hydrocarbons from these wells, have to flow through these cold deep water ocean temperatures, through risers to a platform and in some cases through miles of sub-sea flow lines cooling off the hot hydrocarbon fluids coming from these subterranean depths of off shore wells causing many forms of substances to form in the well flow conduits. The present invention includes a way to heat these wells, flow lines, sub-sea well heads, and riser pipes to melt these substances using a combusted monopropellant fluid injected through at least on subsea catalytic reactor, or in long flow lines a series of catalytic reactor nodes disposed throughout the flow conduits.

In a still further embodiment, a reaction chamber disposed in the well with catalyst disposed inside a reactor which is connected to surface by a conduit transmitting monopropellant to the reaction chamber transmits the combustion products to a work extraction device like a turbine, pump, or compressor. The turbine can be connected to a drill bit and used to drill items in the well, or used to turn a pump or compressor. Likewise, the combustion products from this inventions reaction chamber can be transmitted through jet orifices to impart increased velocity to the combustion products, which in turn can cut items in wells. The present invention also includes a method of removing plugs from wells by melting them or exploding them by heating them with the combustion gases from the catalytic reactor. In some embodiments, blend of inert diluents, hydrogen fuel, and oxygen gas in a monopropellant are decomposed over a down hole catalyst inside a conduit extending from the surface to just above the down hole plug the plug in the well casing or well production tubing is removed. The plugs can consist of steel and or plastic devices or chemical plugs.

In another embodiment, the combustion products released from the combustion chamber after catalytic combustion lift fluids from the wells due to the hot temperature of the combustion fluid and its low density. This is a new type of gas lift where gas lifting with methane gas compressed from surface is well known in the art of oil and gas recovery. In this embodiment at least one reaction chambers can be located at any well depths in side pocket mandrels previously disposed with the production tubing. These side pocket mandrels or more commonly known to those familiar with the oil and gas industry as gas lift mandrels are designed to dispose gas lift valves in them. Some embodiments include the use of side pocket mandrels for catalytic reaction chambers being disposed inside side pocket mandrel assemblies connected to production tubing. The oil and gas industry has many well known methods of deploying and recovering gas lift mandrels through tubing. One aspect of the present invention teaches using this such gas lift technology in a new way to deploy and retrieve reaction chambers from the wells side pocket mandrels thereby facilitating the maintenance of the reaction chamber and catalyst therein. Therefore, by the novel placement of catalytic reaction chambers in side pocket mandrels, a monopropellant may be injected down the casing by production tubing annulus or through a capillary tube extending parallel and attached to the production tubing from surface to the various down hole side pocket mandrels allowing the monopropellant blends to be transmitted from surface down a well conduit over a catalyst bed located inside a side pocket mandrel and out into the production and then exhaust the decomposition fluids from the catalyst into the production tubing combining with reservoir fluid therein heating and decreasing the density of the fluids in the well to assist them to be produced to surface. This injection of monopropellants and catalytically combusting them through side pocket mandrels has the industrial purpose of melting paraffin, waxes, diamondoids, hydrates, asphaltenes and indeed heating natural gas fluids to reduce the condensation of water as the gas is flowed up the production tubing.

This side pocket method and embodiment of the present invention may use a monopropellant comprising a fuel to oxidizer such that the oxygen is fully decomposed upon exit of the catalytic reaction producing exhaust products containing heat, inert gases, and steam into the production tubing. This then allows wells that have paraffin plugging problems in the tubing to be treated periodically or continually with my monopropellants which will keep the paraffin from forming or after they form allow for them to be melted and transported to surface by the exhausted catalytic combustion products as opposed to hot oil methods not used wherein the melted paraffin and other solids are transported down into the well and out of the production tubing down hole catalytic reactor being located in the tubing string side pocket mandrel.

In some embodiments, a suite of logging tools is deployed with the reaction chamber having a catalyst inside on a tube down into a well wherein the logging suite is fitted with instrumentation and devices that obtain subterranean data and send data to surface up a conduit (for example, a copper wire or an optical wave guide), where the data is then recorded. These logging instruments are well known to those familiar to the art of well logging and include but are limited to, gamma ray tools, acoustic tools, temperature monitoring tools, distributive optical time domain reflectometry temperature and acoustic fiber with surface LASER and computational equipment, pressure monitoring tools, flow monitoring tools and a variety of other instruments that record and transmit data to surface. In this embodiment, the decomposition of the monopropellant release large amounts of heat and the location of the logging tools via surface read out data, and the known location of the reaction chamber on the logging tube allows the practitioner to know correlate the depth of the reaction chamber in the wells depth. This ability to run logging tools in the conduit for monopropellant and catalytic reaction chamber allows the practitioner the ability to melt out plugs a given depths, heat down hole tubular and weldments, and other such down hole interventions owing to correlation ability of this inventions disposing of logging tools with surface readout along with the catalytic reaction chamber and monopropellant conduit extending from surface down to into the well.

In various embodiments of the method, data is transmitted from the tools to surface with a wire located inside the coiled tubing whilst monopropellant is being injected down the coiled tubing, and in other embodiments the data is transmitted to surface using optical fibers. In still other embodiments, data is transmitted up the conduits disposed in the wells wherein the logging tube is a copper alloy conductor. Prior practice uses wire wrapped wire line means to conduct logging tools into wells, whereas improvements described herein use coiled tubing for both logging tool deployment means and the transmission of monopropellant down the same logging conduit.

In one aspect of the present invention, there is a method of constructing a well apparatus for recovery of hydrocarbons from a subterranean reservoir fluidly coupled to a wellbore of the apparatus, the method comprising: providing a reservoir for a composition comprising a monopropellant, the composition substantially free of hydrogen peroxide, hydrazine, or Otto Fuel; inserting from surface, with a coiled tubing injector head, a first conduit into the wellbore, the first conduit having a proximal end at surface and a distal end below the surface, the first conduit fluidly coupled to the monopropellant composition reservoir; engaging, at surface, the first conduit with the coiled tubing injector head; connecting a catalytic reaction chamber at a point along the length of the first conduit, the reaction chamber having intake and exhaust fluid ports fluidly coupled to the first conduit, the catalytic reaction chamber having a catalyst composition disposed in it; and, attaching a check valve on the first conduit or on the catalytic reaction chamber, wherein the check valve is: disposed on the catalytic reaction chamber at a position downstream from the catalyst composition in the reaction chamber, or, disposed on the first conduit at a location closer to the distal end of the first conduit than the location of the reaction chamber.

In some embodiments, the step of providing a catalytic reaction chamber at a point along the length of said first conduit, comprises providing a catalytic reaction chamber at or above surface. In some embodiments, the first conduit is a continuous coiled tubing. In some embodiments, the method further comprised the step of providing a second conduit in the wellbore. In some embodiments, the first conduit is a continuous coiled tubing and is disposed in the wellbore concentrically through the wellhead and the second conduit. In some embodiments, the first conduit is disposed on the outside diameter of the second conduit. In some embodiments, the method further comprises the step of fluidly coupling the first conduit to at least one side pocket assembly and having the catalytic reaction chamber disposed in the side pocket, and fluidly coupling the side pocket to the second conduit. In some embodiments, the method further comprised the step of retrieving to surface through the second conduit the catalytic reaction chambers. In some embodiments, the method further comprises the step of moving the first conduit and the reaction chamber through the wellbore and simultaneously injecting the monopropellant composition from surface through the reaction chamber, across the catalyst, through the reactor exhaust port, through the check valve, and into the wellbore.

In another aspect of the present invention there is a method of recovering hydrocarbons from a subterranean reservoir fluidly coupled to a wellbore, the method comprising: introducing a composition comprising a monopropellant into a first conduit, the first conduit extending into the wellbore having a proximal end at surface and a distal end below the surface in the wellbore, the first conduit fluidly coupled to a catalytic reaction chamber, the first conduit having a check valve disposed on it or disposed on the first conduit between the distal end and the reaction chamber, the composition substantially free of hydrogen peroxide, hydrazine, or Otto Fuel; flowing the composition comprising a monopropellant into the catalytic reaction chamber through the first conduit; conducting catalytic reaction products and/or heat formed by the step of flowing the composition comprising a monopropellant into the catalytic reaction chamber, the step of conduction comprises conducting the reaction products and/or heat into the wellbore or into the subterranean reservoir, or into both the wellbore and the subterranean reservoir; and, flowing reservoir fluids from said subterranean reservoir through a well.

In some embodiments, the step of conducting comprises conducting the catalytic reaction products and/or heat into the subterranean reservoir. In some embodiments, the method further comprises the step of moving the first conduit and the reaction chamber through the wellbore while simultaneously injecting the monopropellant composition from surface.

In another aspect of the present invention, there is a method of recovering hydrocarbons from a subterranean reservoir comprising: introducing a first composition comprising a monopropellant into a first conduit, the first conduit extending into a wellbore, the first conduit having a proximal end at surface and a distal end below the surface in the wellbore, the first conduit fluidly coupled to a catalytic reaction chamber, the first conduit having a check valve disposed on it or disposed on the first conduit between the distal end and the reaction chamber, the check valve being fluidly coupled to the first conduit and the reaction chamber, the first composition substantially free of hydrogen peroxide, hydrazine, or Otto Fuel; flowing the first composition into the catalytic reaction chamber through the first conduit; simultaneously flowing a second composition down a second conduit extending into the wellbore, the second composition substantially free of an oxidizer component; heating the second composition with heat generated from the step of flowing the first composition into the catalytic reaction chamber, to form a heated second composition; introducing at least the heat with the second composition into the subterranean reservoir; and, producing reservoir fluids from said subterranean reservoir to surface through a well.

In some embodiments, the second composition comprises a micro-emulsion. In some embodiments, the method further comprises the step of injecting the heated second composition into at least one injection well reservoir and producing it to surface from at least one separate production well reservoir. In some embodiments, the injected heated second composition comprises a supercritical state as it enters the subterranean reservoir. In some embodiments, the first composition comprising a monopropellant comprises a cryogenic fluid. In some embodiments, the second composition comprises an alkane. In some embodiments, the second composition comprises ammonia. In some embodiments, at least a portion of the second composition is recovered at surface, separated from well fluids, and re-cycled and re-injected into a wellbore. In some embodiments, the second composition comprises water. In some embodiments, the first composition comprises propane and oxygen. In some embodiments, the first composition comprises hydrogen and oxygen. In some embodiments, the first composition comprises nitrogen. In some embodiments, the heated second fluid is injected at a pressure above the fracture gradient of the reservoir.

In another aspect of the present invention, there is a well apparatus for the recovery of hydrocarbons, the apparatus comprising: a wellbore extending from surface to a subterranean region and fluidly coupled to a subterranean hydrocarbon-containing reservoir, a first conduit disposed, at least in part, in the wellbore, the first conduit engaged with a coiled tubing injector head, the first conduit having proximal end at surface and a distal end below the surface in the wellbore; a catalytic reaction chamber disposed at a point along the length of the first conduit, the reaction chamber having intake and exhaust fluid ports fluidly coupled to the first conduit, the catalytic reaction chamber having a catalyst composition disposed in it; a check valve fluidly coupled to the first conduit, the check valve being disposed on: the catalytic reaction chamber, in a position downstream the catalyst composition of the reaction chamber, or, the first conduit at a location closer to the distal end of the first conduit than the location of the reaction chamber.

In some embodiments, the method further comprises a second conduit, the second conduit fluidly coupled to the subterranean hydrocarbon-containing reservoir.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
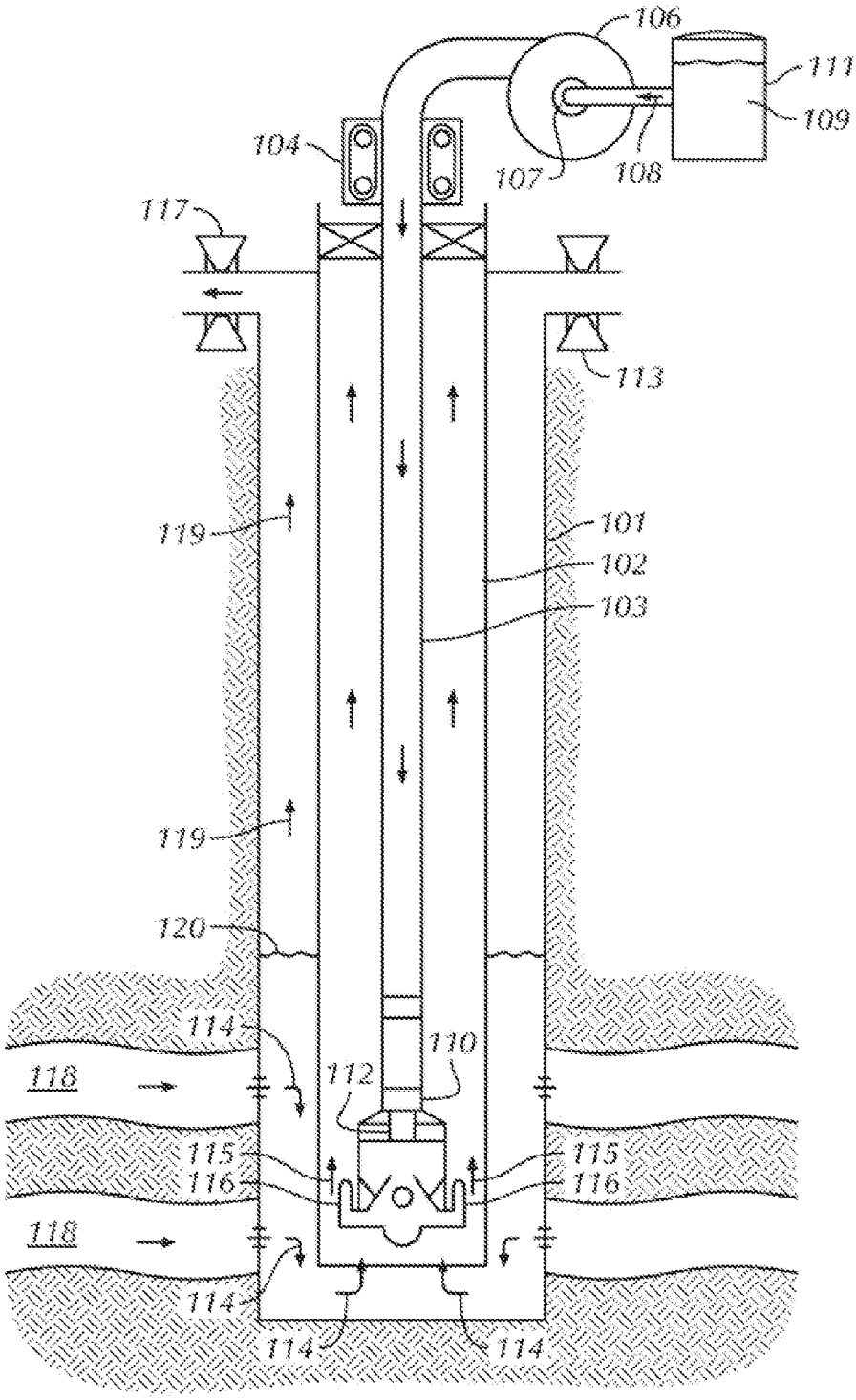
FIG. 1 illustrates a well completion with coiled tubing being used to lift fluids to surface from a well using the subterranean catalytic combustion fluids of a monopropellant injected from surface.

As used herein, "a" or "an" means one or more. Unless otherwise indicated, the singular contains the plural and the plural contains the singular. For example, as used herein, the term "logging tool" includes both a single logging tool and more than one logging tools arranged in any way, such as a suite of logging tools. Where the disclosure refers to "perforations" or "penetrations", it should be understood to mean "one or more perforations" and "one or more penetrations", respectively.

As used herein, "surface" refers to locations at or above the surface of the earth and should be understood to include those locations slightly below the surface of the earth but nevertheless substantially near the surface such that typical surface operations in hydrocarbon exploration and recovery can feasibly be performed.

As used herein, "hypergolic" refers to propellants that react immediately (i.e., spontaneously ignite) when combined together. "Non-hypergolic" refers to propellants that do not react immediately when combined together.

As used herein, "monopropellant" refers to propellant compounds that comprise at least one oxidizer constituent and one fuel constituent and do not combust or decompose hypergolic at ambient conditions without an ignition source.

As used herein an "alkane" is defined as an organic molecule comprising elements of carbon and hydrogen wherein these atoms are linked together exclusively by single bonds and are said to be saturated organic compounds. Alkanes include, but are not limited to, propane, butane, methane, ethane, hexane, and pentane.

As used herein, a side pocket assembly is a well known apparatus from the field of gas lifting that is connected to a production tubing sting that is deployed into a well where said side pocket assembly has an internal upset, commonly known as a side pocket, that is parallel to the axis of the production tubing. Side pocket mandrels have receptacles for the disposing of gas lift valves, chemical injection valves, and other devices such that these disposed devices allow fluids from the outer diameter of the production tubing to be transmitted through the disposed devices and into the internal diameter of the production tubing. Side pocket assemblies are often referred to as side pocket mandrels by those familiar with the field of artificial lift known as gas lifting.

As used herein, cryogenic is defined to temperatures below −240° F.

As used herein, "platinum family of catalyst" refers to a catalyst comprised of at least Ruthenium, Rhodium, Palladium, Osmium, Iridium, and Platinum or blends of these elements that participates in the ignition or decomposition of a fluid but said catalyst substance is not consumed in the reaction, decomposition, or resulting combustion.

As used herein, "supercritical fluid" refers to a fluid that is in a thermodynamic state or phase of matter above its critical point with regards to the pressure and temperature of the fluid. Therefore, when a fluid is simultaneously above both it's critical pressure and its critical temperature the fluid is said to be in a supercritical fluid state or phase.

This invention teaches the methods and apparatus to practice subterranean catalytic combustion methods of monopropellants. The invention uses catalyst selected from elements of the "d block" of the periodic table, sometimes known as the transition metal group, labeled below and shaded in yellow in a presentation of the Periodic table of Elements.

The preferred embodiment of this invention teaches the use of catalyst elements from the Platinum Group in the "d-block" of the Periodic table further defined as Platinum Group Metals in "d-block" wherein this invention teaches the use of these six platinum group elements; Ruthenium, Rhodium, Palladium, Osmium, Iridium, and Platinum.

The present invention includes methods of well construction and well completion assemblies that use catalyst reactor deposition methods to uniquely combust monopropellant blends in subterranean environments. The exhaust products yield less corrosive decomposition fluids as compared to hydrogen peroxide, hydrazine, Otto fuels and other monopropellants known to those familiar with monopropellant blends. These exhaust products are conducted into a wells production fluids therein avoiding current technology monopropellants corrosive exhaust products and their inherent delirious effects on production tubing sucker rods, flow lines, and well heads. The preferred embodiment of the side pocket mandrel catalytic reaction chamber method uses a family of proprietary monopropellant blend injected from surface and injected down into the well through a conduit that extends from the surface supply of monopropellant to at least one catalyst bed located in a reaction chamber transmitting the exhaust products of the catalytic reaction into the well. The down hole reaction products are mixed with non oxygenated reservoir fluids or non-oxygenated fluids injected from surface pumped simultaneously down a separate conduit.

In one embodiment, the invention makes use of non-oxygenated propane injected at surface to a separate conduit than the monopropellant. In one embodiment the non-oxygenated fluid injected from surface comprises deoxygenated ammonia. The surface injected non-monopropellant fluid like propane or ammonia mixes with the decomposition products of the catalytic combustion and the resulting blend is injected into the well. In these embodiments the temperature of the blend of non-monopropellant fluids and catalytic combustion products is held above the blends super critical temperature and pressure by controlling the rate of injection of the non-monopropellant fluid injected through one well conduit whilst the monopropellant fluid is injected through a separate well conduit and through the catalytic reactor. The skilled practitioner of my invention will vary the amounts of non-monopropellant to water ratio injected depending on the specific reservoir hydrocarbon's solubility, the depth of the well, and the fracture gradient. The deeper the well the more deoxygenated water can be added to the deoxygenated ammonia and still stay above the blend at supercritical conditions.

One embodiment teaches the use of a non-hypergolic monopropellant fluid prepared at surface prior to transmission into the well. This non-hypergolic monopropellant contains at least one fuel and one oxidizer that upon mixing will not immediately combust at ambient conditions. The invention further embodiments wherein the mixing in subterranean wells of the products of the catalytic combustion reaction of the monopropellant with the well fluid and well environment. The monopropellant systems of the present invention obviates corrosive and health challenges well compared to other monopropellants used in oil and gas wells like hydrogen peroxide, hydrazine, Otto fuel, and unsymmetrical dimethylhydrazine.

In the preferred embodiment at least one monopropellant is a non-hypergolic monopropellant blend prepared and stored in a surface vessel. This vessel can be pressurized or a pump or compressor can be used to transmit the hypergolic monopropellant fluid from the surface vessel into a continuous coiled tubing conduit, coiled tubing reel, through slip ring apparatus attached to the coiled tubing reel allowing the continuous coiled tubing to be lowered into a well environment. One embodiment has a reaction chamber with a catalyst attached near the distal end of the coiled tubing in the well and allows a non-hypergolic monopropellant made substantially from noble gases, inert gases, a fuel, and an oxidizer to be combusted in the well while the coiled tubing is moved through the well conduits. This preferred embodiment uses a blend of inert fluid like argon between 50-98%, hydrogen fluid between 0.5 and 20%, and oxygen fluid between 0.5 and 10%. Other noble gases and inert gases maybe used in the non-hypergolic monopropellant and other fluids can be blended in the well with the non-hypergolic combustion products without substantially changing the teaching of this embodiment. Likewise, the simultaneous injection of other fluids from surface to blend with the subterranean released catalytic combustion fluids and energy of this invention discussed herein can be substituted without changing the teaching or departing from the inventiveness of this invention.

Figure 5:
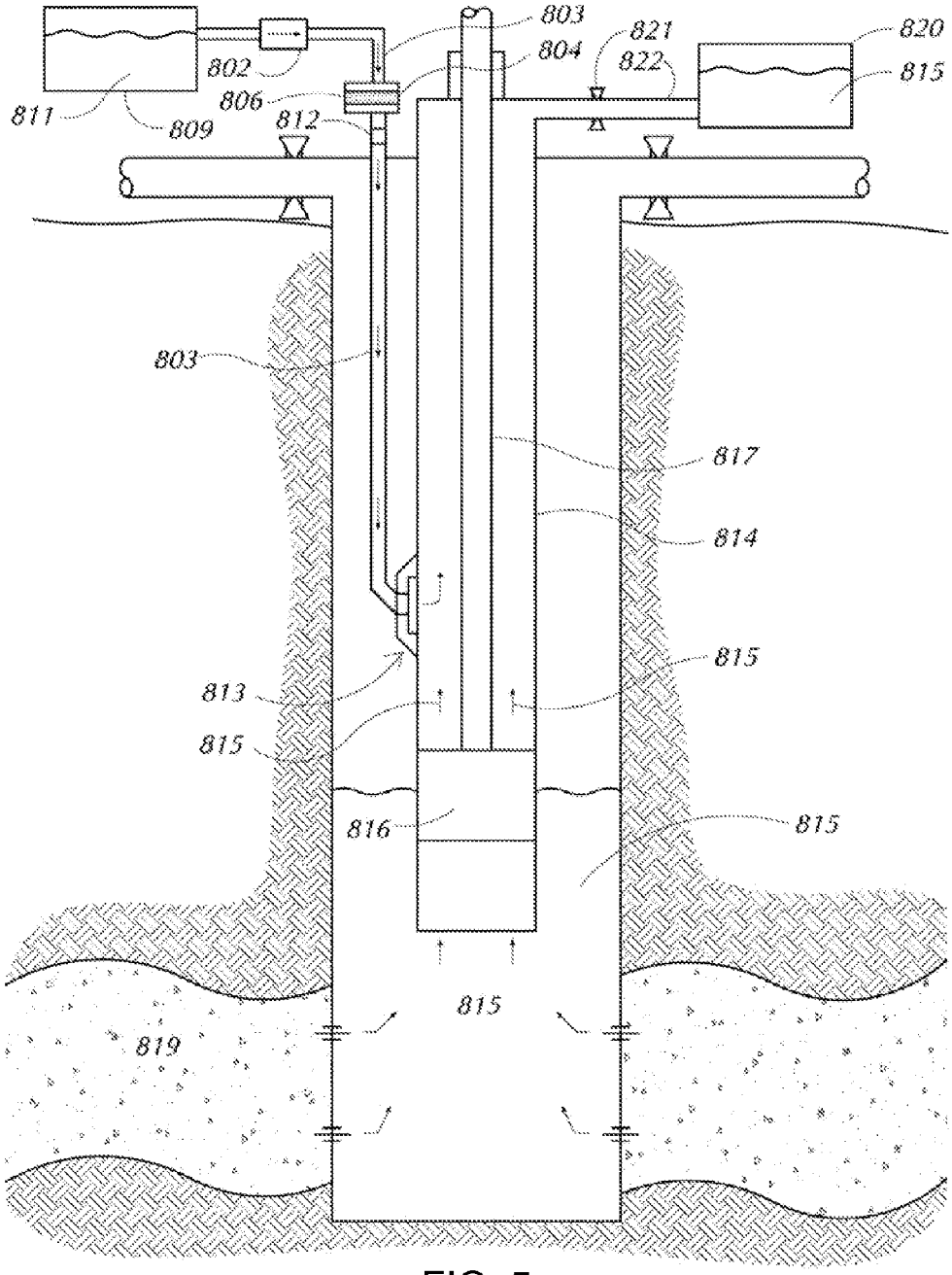
FIG. 5 is a sketch showing the method and apparatus of a well completion used to melt and fluidize paraffins and other composition from a production tubing while simultaneously pumping well fluids to surface.

Attention is now drawn to the preferred embodiment of FIG. 5 where a non-hypergolic monopropellant blend 811 is prepared and stored in a surface vessel 809. The fluid from vessel 809 is pressurized with a pump 802 thereafter passed through a catalytic reaction chamber 804 and reacted over catalyst 806 disposed in the catalytic reaction chamber 804. The hot catalytic exhaust is conducted through the conduit 803 then through the check valve 812 thereafter the catalytic combustion products continue through conduit 803 to a side pocket assembly 813 where in the conduit 803 is fluidly coupled to the production tubing 814 and the hot catalytic exhaust gas from the surface catalytic reaction chamber 804 is mixed with well fluids 815 inside the production tubing 814. The illustrative example of FIG. 8 presents a well pump 816 and sucker rods 817 being deployed in the production tubing 814 such that the well fluids 815 can be transduced from the reservoir 819 through the pump 816 with the reciprocation from surface of the sucker rods 817 while simultaneously injecting monopropellant 811 of this invention with pump 802 combusted in a surface catalytic reaction chamber 804 and the combustion and decomposition products are injected whilst pumping the well with a rod pump. This method then teaches towards producing well fluids 815 from wells that precipitate paraffins, asphaltenes, hydrates, and other solids inside the production tubing 814 without stopping the well pump 816. This method removes said precipitates with the well fluids 815 to a surface tank 820 through the production tubing 814 thereafter through a surface valve 821 and through surface flow line 822 with the heat and decomposition products from this inventions reaction chamber 804 which melts and fluidizes said precipitates into the well fluid 815 and lifts said fluidized compositions with well fluids 815 to surface tank 820 without injecting said precipitates into the reservoir 819 and without stopping the wells production pump 816.

Figure 6:
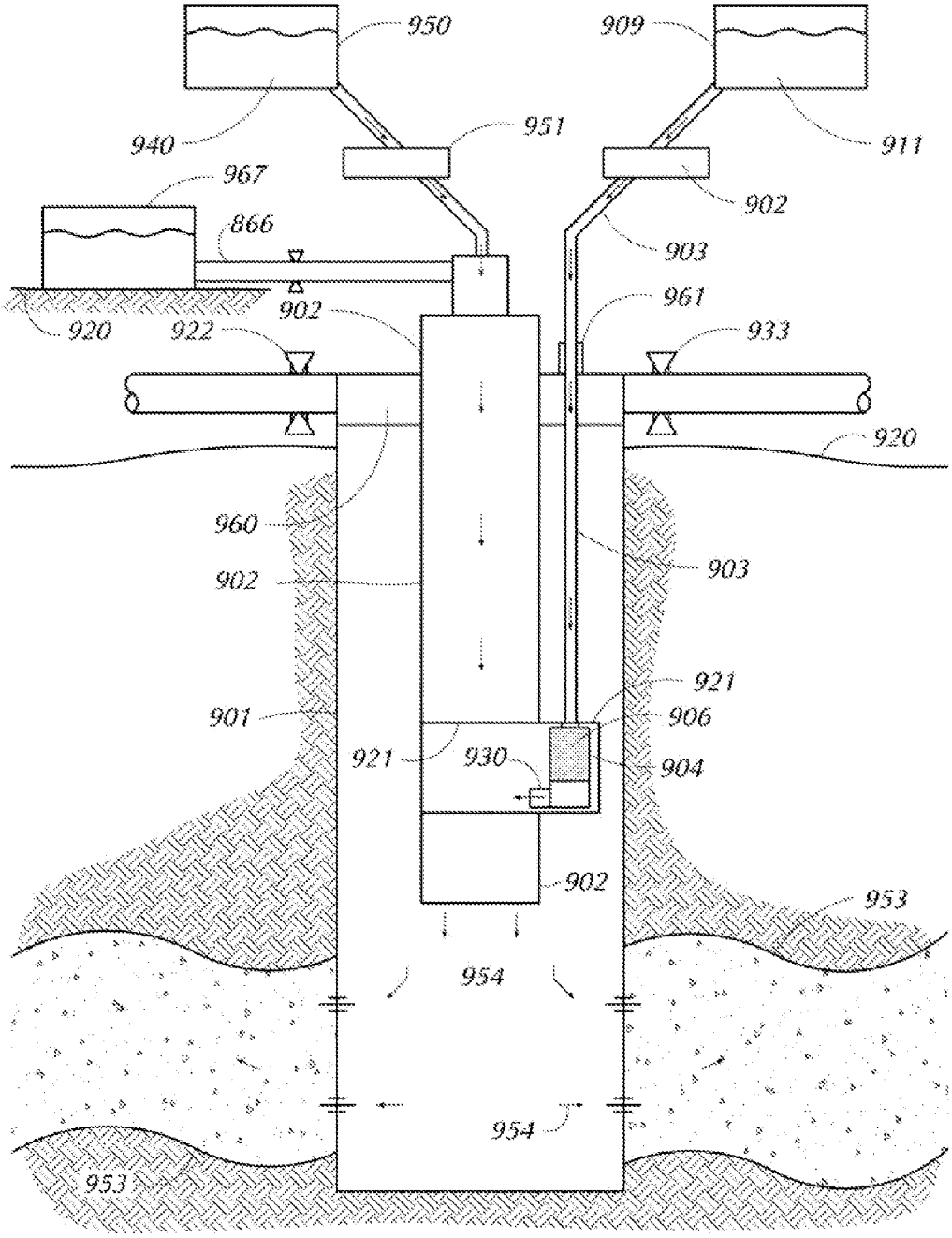
FIG. 6 is a sketch of an injection well in an enhanced oil recovery project where a fluid is injected and heated with a second monopropellant fluid down hole to its supercritical thermodynamic state and injected into an oil reservoir; and, FIG. 7 illustrates one example of a method and apparatus to heat a fluid in a subterranean horizontal well bore with a monopropellant to supercritical temperatures and pump the fluid at supercritical pressures into a reservoir.

FIG. 6 further demonstrates the apparatus and configurations thereof of an embodiment of the present invention used to complete a well and to practice the invention for the industrial purpose of increasing oil and gas recovery from a reservoir; wherein a rig is used to deploy a catalytic reaction chamber 904 below the surface 920 on production tubing 902. The catalytic reaction chamber 904 is disposed in a side pocket assembly 921. The side pocket assembly 921 is connected to and deployed simultaneously with the production tubing 902 and the monopropellant conduit 903 into the well casing 901 where the production tubing 902 is landed in the wellhead 960 and the monopropellant conduit 903 penetrates and is hydraulically sealed in the wellhead 960 with a connector means 961, which can be, among other things, a sage lock ferrule connector. The reaction chamber 904 has disposed inside of it, a catalyst 906. Downstream of the catalyst 906 and the reaction chamber 904 prior to the injection of the catalytic decomposition and combustion products from reaction chamber 904 to the internal diameter of the production tubing 902 a check valve 930 is connected to the reaction chamber 904 to prevent well fluid from flowing into the reaction chamber 904 from production tubing 902 and poisoning the catalyst 906.

Now FIG. 6 will be used to demonstrate one non-limiting example of how the apparatus is used to enhance hydrocarbon production from wells using the method described herein to heat fluids injected from surface to their supercritical thermodynamic state prior to their injection into a reservoir to enhance oil and gas production. Firstly, casing valves 922 and 923 are closed. Then my monopropellant blend 911 is pumped from a surface vessel 909 with a pump 902. In one embodiment the tank 909, the pump 902 and the monopropellant 911 are cryogenic vessels, pumps, and fluid respectfully. In other embodiments 909 is a gas vessel, 902 is a compressor, and 911 is a gaseous monopropellant. Once the monopropellant 911 is injected through 902 and into injection conduit 903 it is conducted to a side pocket assembly 921, where in the monopropellant is conducted through the side pocket assembly 921 to the reaction chamber 904 inside the side pocket assembly 921. The monopropellant is then combusted and decomposed over the catalyst 906 located inside the reaction chamber 921 and the exhaust products are mixed with injection fluid 940 that comprises a non-oxidizer fluid. In the preferred embodiment fluid 940 is anhydrous ammonia and is pumped from a surface tank 950 through a pump 951 into the well through the production tubing 902 where the ammonia is mixed with the combustion and decomposition products of the monopropellant 911 after the down hole reactor chamber 904. The mixed hot fluid blend 954 is then injected into a reservoir 953 as a supercritical fluid. It will be clear to those familiar to art of oil and gas production that the injection process can be continual, in a flood operation where this well is an injection well and the mobilized hydrocarbon in reservoir 953 is mobilized to a separate production well. It will be further discovered by those familiar with the art of oil and gas production the method hereinabove described can be practices as a "huff and puff" operations wherein the hot fluid mix 954 is injected into the reservoir 953 for a period and then the well fluids from the reservoir are flowed back up the production tubing 902 to surface 920 through a flow line 966 to a surface tank 967. Therefore, this method can be practiced as a stimulation or fracture treatment method or as a primary, secondary, or tertiary recovery method such as pressure maintenance, water floods, surfactant flooding, and supercritical flooding of reservoirs. The stimulation or fracture method used to produce and increase hydrocarbon fluids is often referred to by those familiar to the art of oil and gas production as fracturing or matrix stimulation. Fracturing is injection of fluids wherein the down hole pressure exceeds the hydraulic fracture pressure of a reservoir. Matrix stimulation is where the bottom hole injection pressure during fluid injection is below the fracture gradient of the reservoir.

Figure 7:
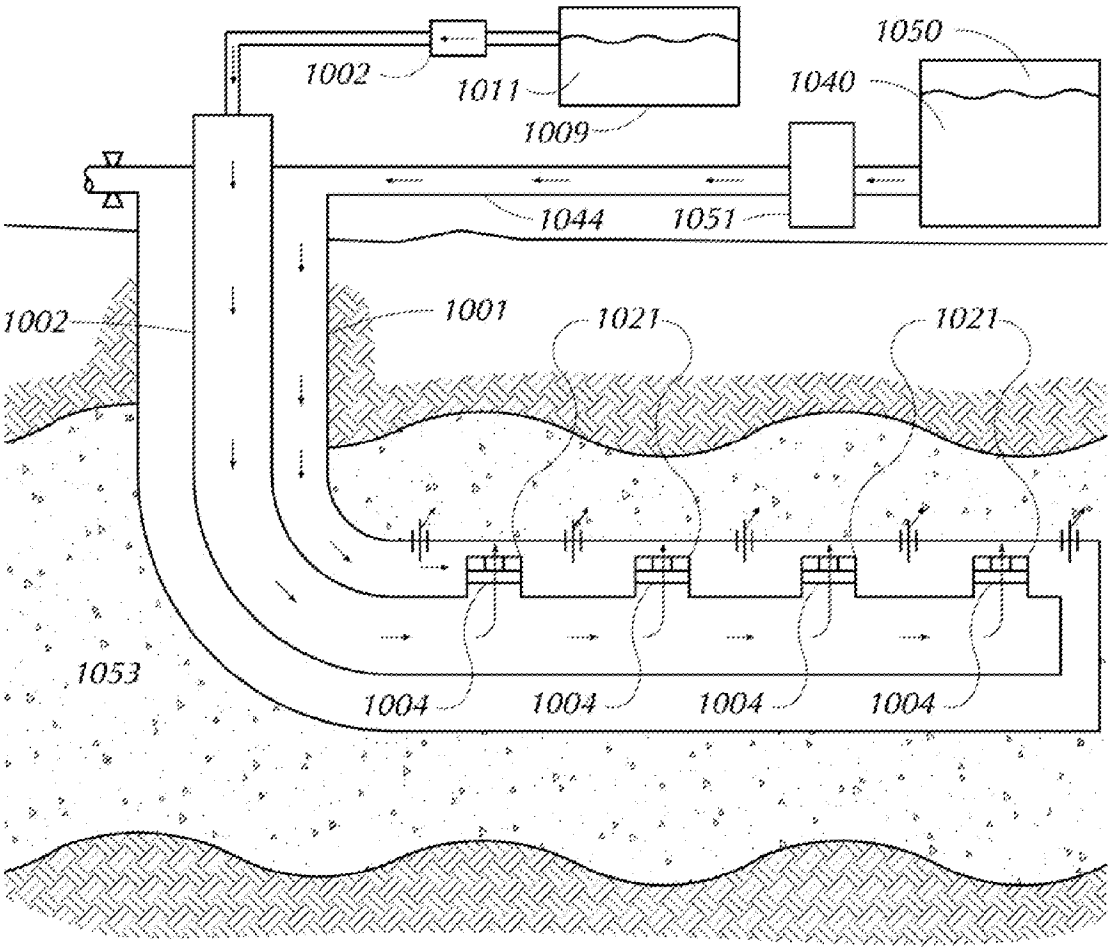

FIG. 7 is one example of the invention practiced in a horizontal well where a monopropellant 1011 is presented at the well in a tank 1009 injected with pump 1003 down a well tubing 1003 through a plurality of catalyst beds located down in the well in a plurality of side pocket assemblies 1021. Production tubing 1002 is deployed into well casing 1001 simultaneously with a plurality of said side pocket assemblies 1021 located in the horizontal well section in reservoir 1053. A monopropellant 1011 is pumped from tank 1009 through a pump 1003 down into the well production tubing 1002. The monopropellant is injected through the side pocket assemblies 1021 across catalyst beds 1004 and out through check valves connected on each side pocket assembly 1021 after the catalyst 1004 whilst simultaneously a non-oxygenated fluid 1040 is pumped from tank 1050 through a pump 1051 and conducted to the well casing 1001 through surface conduit 1044 and conducted down hole to mix with the hot exhausted fluids from the catalytic reactors 1021 where the mix of fluid 1040 and the catalytic combustion exhaust from the catalytic reactors 1021 is injected into the reservoir 1053 at super critical temperature and pressure. This supercritical fluid migrates through the reservoir 1053 to other production wells fluid coupled to reservoir 1053 where reservoir fluids and the heated fluids 1040 and 1011 and the catalytic combustion fluids are produced to surface. The experienced practitioner of enhanced oil recovery will understand that at least a portion of the fluid 1040 that is heated to supercritical thermodynamic conditions and injected into said reservoir 1053 maybe recovered to surface from said production wells through their connection to said reservoir 1053 separated from well fluids at the surface of these production wells and recycled back to tank 1050 where it is re-injected.

Attention is now drawn to FIG. 1 where an illustrative embodiment of the present invention is shown. This is directed to the art of well completions, and more specifically the art of coiled tubing in oil and gas wells. FIG. 1 presents a well comprising a wellbore constructed in the earth surface with a casing conduit 101 grouted into the wellbore and a production conduit 102 disposed in the well bore casing 101 having a continuous conduit 103 disposed in a production conduit 102 wherein the continuous conduit 103 is engaged at surface with a coiled tubing injector apparatus 104. This embodiment has the continuous conduit 103 inserted into the well environment through an elastomeric seal 105 wherein the elastomeric seal separates the well environment from the surface environment. The continuous tubing in this embodiment is deployed from a coiled tubing reel 106 containing a hydraulic slip ring 107 that allows the coiled tubing reel 106 to turn while a stationary fluid conduit 108 from a surface vessel 109 is attached to the coiled tubing reel 106 thereby allowing monopropellant fluid 109 to be injected into the coiled tubing 103 mounted on the coiled tubing reel 106 while simultaneously moving the coiled tubing 103 in side the production tubing 102.

The preferred embodiment illustrated in FIG. 1 teaches the attachment of a reaction chamber 110 having a catalyst 112 previously disposed inside the reaction chamber 110 to be disposed, articulated through, and retrieved from the well environment while attached to the distal end of continuous conduit 103 through the production conduit 102 by the coiled tubing injector head 104. The preferred embodiment of the invention further teaches the blending at the surface of a non-hypergolic monopropellant 111 and the subsequent transmission of said non-hypergolic monopropellant 111 from the surface vessel 109 through the continuous tubing 103 to a catalyst structure 112 disposed inside the reaction chamber 110. The preferred embodiment teaches the blending on surface of a non-hypergolic fluid or monopropellant that is by design non-explosive and requires an ignition source to combust or decompose. The preferred embodiment further specifies the blending of a non-hypergolic fluid which will have catalytic combustion products that do not contain oxidizers, acids, or other corrosive fluids in the combustion products. The preferred embodiment further teaches the application method of reciprocation of the reaction chamber 110 and continuous tube 103 in the well below elastomeric device 105 using a surface injector head apparatus 104 and coiled tubing reel 106 while monopropellant 109 is being combusted and exhausted from the catalytic reaction chamber 110 where the monopropellant is transmitted from surface vessel 109 through surface conduit 108 and through the slip ring device 107 into the continuous conduit 103 on reel 106. The method further teaches the opening of valve 113 wherein at least a portion of the well fluids 114 are combined with catalytic combustion products 115 exiting the reaction chamber 110 through nozzles and the combined fluids are produced to surface through the production tubing 102 and valve 113. The invention further shows, in FIG. 1, a portion of the well fluids 119 being produced up the well casing 101 through casing valve 117. Therefore, this embodiment allows for well fluids like water and oil to be lifted up the production tubing 102 with the hot catalytic combustion products proceeding from the reaction chamber 110 due to the monopropellant 111 reacting exothermically with the catalyst 112. Likewise, this method allows for manmade meltable plugs and natural occurring plugs like wax, paraffin, diamondoids, hydrates and other well materials to be melted and produced to surface. The catalytic combustion products 115 of the preferred embodiment non-hypergolic monopropellants 111 are largely hot inert gases and steam. Therefore, the hot catalytic combustion products 115 exit the reaction chamber 110 through nozzles 116 and mix with the well liquid well fluids 114 enhancing the well fluids rise to surface and relieving hydrostatic pressure created by the liquid well fluids 114 on the subterranean reservoirs 118 thereby allowing enhanced production of well fluids from reservoir 118. This lowering of the hydrostatic pressure against the subterranean reservoirs 118 enhances the flow of gaseous well fluids 119 to the surface of the well casing 101 through valve 117 and then to a commercial sales line, tank, or fluid separator facility. This methods and apparatus of this embodiment of releasing heat energy in the subterranean environment through the catalytic combustor 110 is also advantageous to the flow to surface of gaseous well fluids 119 and well liquid well fluids 114 like water, condensates, and other well liquids. The heat exchanged from the catalytic combustion reaction in the reaction chamber 110 to the surrounding well environment and gaseous well fluids 119 and liquid well fluids 114 reduces their respective viscosity and decreases their respective density allowing them to rise to surface faster. Therefore, this embodiment as taught herein can also be advantageously used to enhance liquid production from gas wells. The deployment of the continuous tubing 103 in the production tubing 102 reduces the flow area of the production tubing 102 thereby increasing the combined fluid velocity of well fluids 114 and combustion fluids 115 in the production tubing 102.

This embodiment of illustrated in FIG. 1 will be recognized by those familiar with the art of oil and gas artificial lift methods to allow in certain well applications for well fluid 114, having a liquid level 120, to be lowered and the liquid in the well to be produced up the production tubing 102. In many areas of the world where heavy oil, tar, and bitumen is found or offshore where gas lifting of fluids has been attempted through riser pipes from the sea floor to the surface. The ability to have hot gas lift fluids available to assist with lifting these heavy or viscous well fluids to surface will increase oil and gas production dramatically from wells. The advancements taught by this embodiment will have the advantageous industrial result of increasing the total recoverable fluids from subterranean environments.

Figure 3:
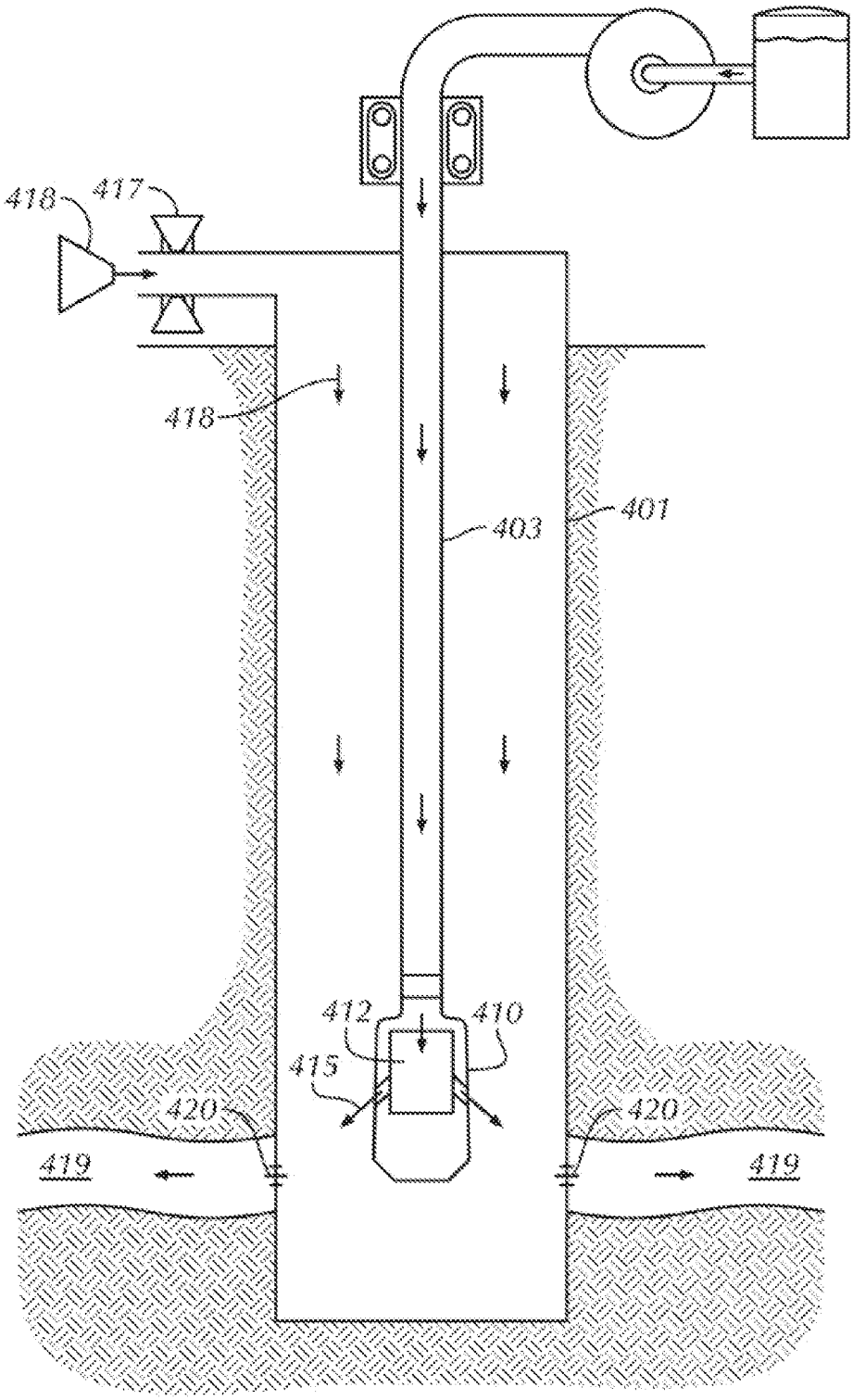
FIG. 3 illustrates hot combustion products of downhole reaction mixed with fluids transmitted from surface.

FIG. 3 shows the continuous tubing 403 with the reaction chamber 410 having a catalyst structure 412 is deployed through a well casing 401 and the hot catalytic combustion products 415 are transmitted and mixed with a second fluid 418 injected from surface such that fluids in the casing 401 and hot catalytic combustion fluids 415 are transmitted into reservoir 419 through casing perforations 420. There after the practitioner of this method can then produced the injected fluid 418 and well fluids 419 back up the production casing 410 to surface. The embodiment as illustrated in FIG. 4 teaches the hot combustion products 415 can be mixed with fluids transmitted from surface 418 and injected into the well through casing 401 where they are mixed with the exhaust combustion products 415 and injected into the reservoir 419 through the perforations 420 in well casing 401 and produced to surface from a separate well.

Figure 2:
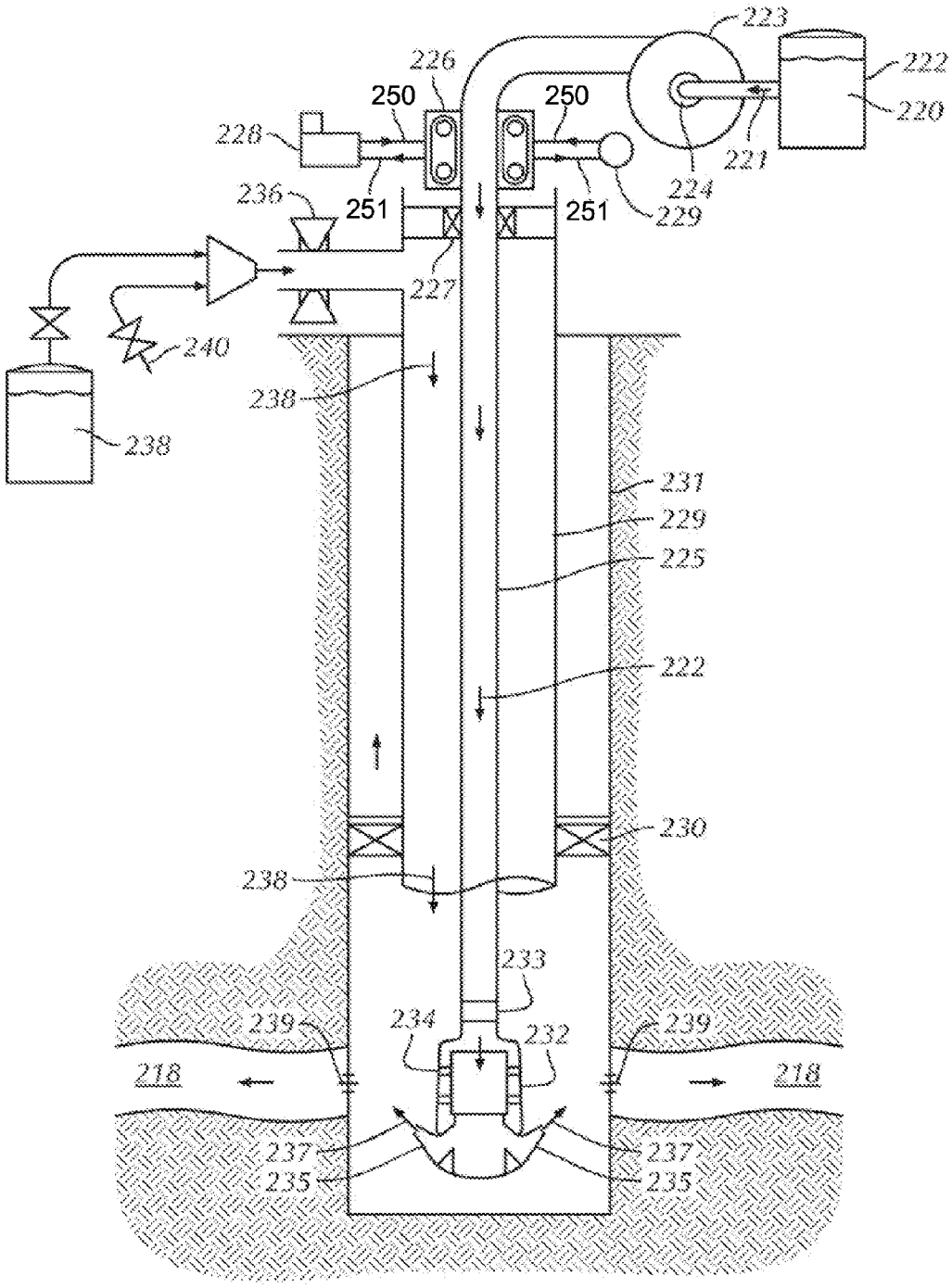
FIG. 2 illustrates a well intervention with a coiled tubing and injector head and coil that uses hot catalytically in-situ combusted monopropellant exhaust fluids to mix with ammonia and inject ammonia as a supercritical fluid into an oil reservoir.

Attention is now drawn to FIG. 2, which illustrates another embodiment of the present invention used in the field of enhanced oil recovery, EOR. This embodiment teaches the use of this invention's methods and apparatus to heat fluids 238 to their respective supercritical phase injected from surface into a subterranean reservoir 218 using a monopropellant composition 220 passed over a subterranean catalyst 234 disposed in a subterranean reaction chamber 232. A monopropellant fluid composition 220 is located in tank 22 and connected to a conduit 221 that allows transport of the monopropellant 220 into to a coiled tubing reel 223 through a hydraulic slip ring device 224 connected to the coiled tubing reel 223. This slip ring device 224 allows the coiled tubing reel 223 to rotate with the conduit 221 held stationary. A continuous length of coiled tubing conduit 225 is located on the coiled tubing reel 223 surface proximal end attached to the coiled tubing reel 223 drum shaft which in turn has a fluid path inside the shaft to the coiled tubing slip ring 224. The coiled tubing conduit 225 has the distal end deployed through a coiled tubing injector device 226 where the coiled tubing injector device 226 mechanically engages the coiled tubing 225 and injects the coiled tubing 225 through an elastomeric device 227. The elastomeric device 227 separates the well environment from the surface environment and is inflated to seal against the coiled tubing 225 allowing the coiled tubing 225 to move into and out of the production tubing 229 while sealing the well environment from the surface environment. The coiled tubing injector device 226 is powered by a hydraulic power system 228 and through hydraulic control lines 250 and 251. The same hydraulic power system is used to rotate the coiled tubing reel 223 when the injector device 226 is injecting or retrieving coiled tubing 225. In this embodiment the coiled tubing conduit 225 is disposed in the well environment through production tubing 229 which has connected near the distal end a well packer device 230 engaged with the well casing 231. The well packer device 230 separates the well casing internal diameter above the packer device 230 from fluids transmitted in production tubing 229 and fluids from the subterranean reservoir 218. This invention further teaches the connection of a reaction chamber 232 connected to or near the distal end of the continuous coiled tubing conduit 225 by a connection means 233. This reaction chamber 232 has a catalyst 234 located inside wherein monopropellant fluid 220 is transmitted through the catalyst 234 and exhausted out through exit nozzles 235. This embodiment is practices by arriving at a well location with a coiled tubing reel 223 a coiled tubing injection device 226, a monopropellant 220 located in a vessel 222 and a hydraulic power pack 228. The injector device 226 is mounted on top of a well above an elastomeric device 227 and a reaction chamber 232 connected to the distal end of the coiled tubing conduit 225 and lowered into the well environment through the elastomeric device 227 and the production tubing 229. Monopropellant 220 is then transmitted from the vessel 222 through a surface conduit 221 into a coiled tubing slip ring connector device 224 into a coiled tubing reel 223 and into the coiled tubing conduit 225. The monopropellant 220 is further transmitted down the coiled tubing conduit 225 into through the reaction chamber device 232 over a catalyst 234 where the monopropellant 220 is exothermically combusted or decomposed over catalyst 234 and the combustion products are exhausted from the reaction chamber device 232 through the nozzles 235 into the well casing 231 below the well packer 230. The surface casing valve 236 is closed for the first portion of this process allowing the reaction chamber catalytic combusted monopropellant 237 to heat up the well environment near the reservoir 218. The products of catalytic combustion 237 are allowed to flow into the reservoir 218 and soak. Then the casing valve 236 is open and ammonia 238 from surface are transmitted to the well environment through the internal diameter of the production tubing 229. The first surface fluid transmitted initially down the coiled tubing 225 is a monopropellant 220 that mixes in the subterranean environment with the ammonia. This embodiment teaches the use of a non-hypergolic monopropellant for fluid 220 that uses a diluent of nitrogen to control the catalytic exhaust gas temperature. The mixing of these monopropellant combustion exhaust fluids 237 and the injected ammonia mix and are then transmitted to the reservoir 218 through the perforations 239 in the well casing 231. This process of injection of combusted monopropellants and heating the ammonia 238 to a supercritical thermodynamic state and then injecting said supercritical fluid in the subterranean environment greatly enhances a oil and gas production from the reservoir by producing the injected fluids and reservoir fluids from a separate production well not shown herein.

FIG. 2 shows the injection of supercritical non-oxygenated solvent fluids 238 in this case ammonia with the hot catalytic combustion products of said monopropellant 220. Likewise, it will be clear to those familiar with the art of enhanced oil and gas recovery (EOR) that the reaction chamber movement through long sections of casing 231 and the transmitting and combusting of monopropellant 220 simultaneously with the injection of other fluids like ammonia can be performed during fracture jobs and in reservoir flooding techniques commonly known as EOR processes.

Figure 4:
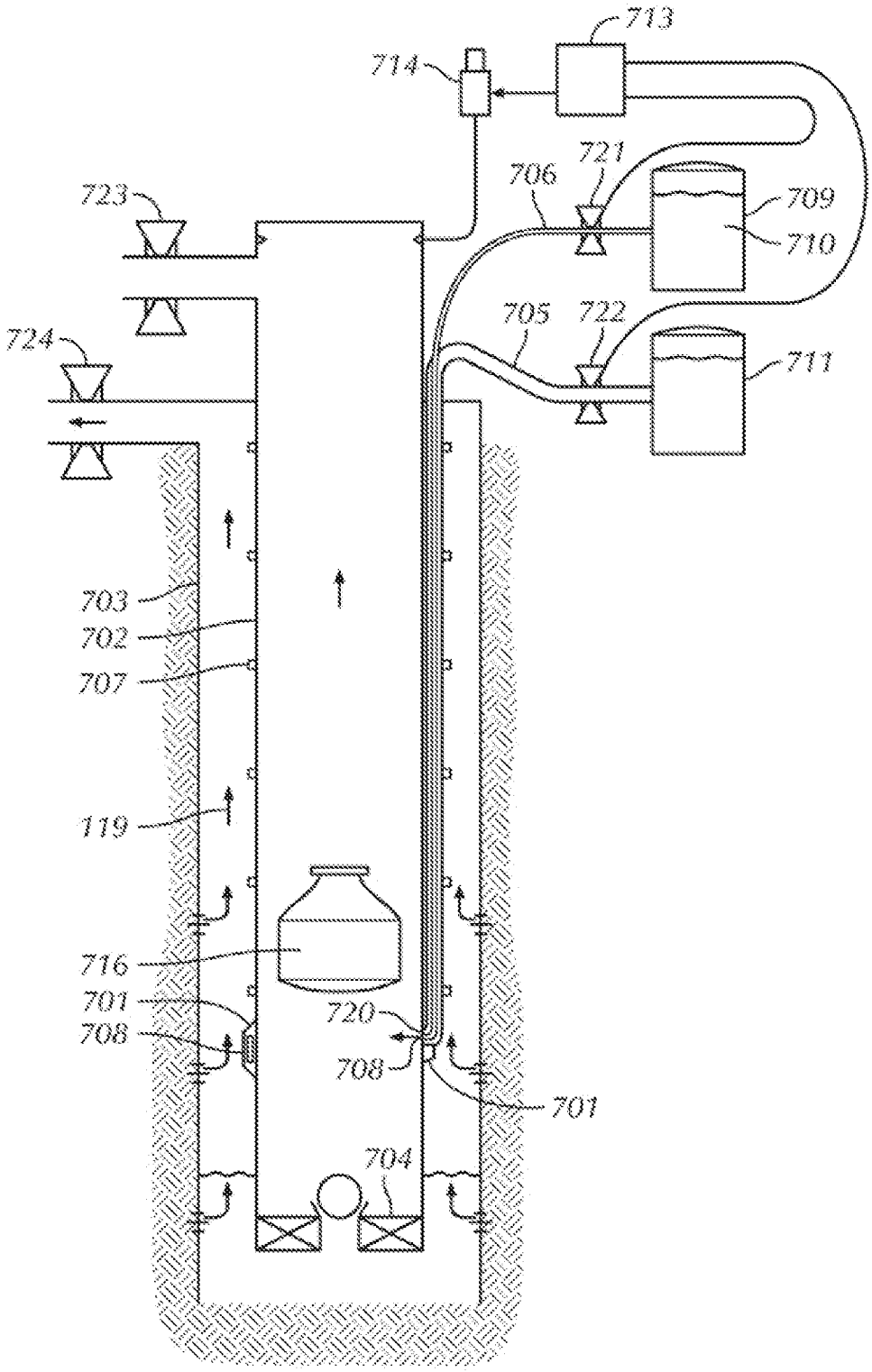
FIG. 4 illustrates a well apparatus using a method of producing well fluids to surface with a plunger partially lifted to surface by a hot catalytic combustion fluids.

FIG. 4 shows a well sketch demonstrating how to apply the present invention to the field of artificial lifting well fluids to surface using a plunger lift apparatus. In FIG. 4 plunger 716 is disposed concentrically inside a production tubing 702. The production tubing is previously disposed in a well casing 703. The well fluids are produced to surface up both the well casing 703 and the production tubing 702. As the liquids in the well accumulate from time to time in the bottom of the a well fluid production is stopped from coming up the production tubing 702 to surface when valve 723 at surface is close by an intelligent surface controller 713 sending signals to the valve 723. This causes the ball 750 to seat in ball cage 704 thereby not allowing fluids that are in the production tubing to flow out the distal end of the production tubing 702. At a set time after valve 723 is closed the intelligent controller 713 sends a signal to the plunger catcher release device 714 which allows the plunger 716 to be dropped from the surface in the production tubing 702 and said plunger 716 is allowed to fall to the plunger seat at the catalytic reactor seat 701 in the production tubing 702. After a time interval controlled by the intelligent surface timer 713 pumps 721 and 722 start pumping monopropellant fluids from tanks 711 and 709 down the 2 separate concentric control lines 705 and 706 which have been previously disposed on production tubing 702 into the well. Fluid 710 is a monopropellant and the fluid from tank 711 is a second monopropellant. Monopropellant from tank 711 is ignited by the exothermic heat of the monopropellant 710 being catalytic combusted over the catalyst 708 in the reactor chamber 720. The fluids pumped from surface tanks 711 and 710 are then injected into the production tubing 702 down hole at the catalytic reactor seat 701 over catalyst 708. Subsequently, the surface valve 723 is opened and well fluids are then lifted to surface through the production tubing 702 by the rising plunger 716 and the rising heated monopropellants and their respective combustion and decomposition fluids. The plunger catcher 714 at surface catches the plunger 716 once it rises to surface. As the fluids are being lifted to surface out of the production tubing 702 the ball at ball seat 704 is lifted off its seat at 704 and fluid from the well casing 703 flow into the production tubing 702. Skilled practitioners of the art of plunger lift will understand that in some wells the casing valve 724 will be closed during the above mentioned process to allow pressure to increase in the casing 703 until the stage where the tubing valve 723 is opened using the pressure stored in the casing 703 during the closure time casing valve 724 is closed to assist in lifting the plunger 716.

This invention teaches the use of specialized down-hole assemblies known to the skilled artisan in the oil and gas industry technique of gas lifting as "side pocket mandrels" for the deployment of catalytic reactor chambers. These side pocket mandrels are cavities built into a tubing conduit where the cavity is not in the axis of the well conduit, thereby allowing logging tools, plungers, coiled tubing and other intervention devices to be lowered passed the cavity without said devices entering the side pocket mandrel. Those familiar with the art of oil and gas completions recognize that the side pocket mandrels can be used with kick over tools and other specialized oil and gas equipment to place and retrieve devices into the side pocket mandrels through the well's production tubing. The side pocket mandrel is normally connected on the outer diameter of the production tubing to a fluid path different than the fluid path on the production tubing's inner diameter. Therefore, devices placed inside pocket mandrels have the feature of communicating fluid from outside the production tubing to inside the production tubing. In the present invention, reaction chambers containing catalyst, disposed inside the side pocket mandrel, are connected to a monopropellant conduit, and allow the transmission of the monopropellant from surface, down a monopropellant conduit, through the connection means of the monopropellant conduit to the side pocket mandrel, into the reaction chamber, across a catalyst, allowing catalytic composition products to exit the reaction chamber in the well.

This invention further teaches a method of controlling the temperature of the catalytic combustion of non-hypergolic monopropellants by controlling the percentage of diluent fluids used in the non-hypergolic monopropellants.

In preferred embodiments of the method of the present invention, there is the use of monopropellant fluids comprising elements from the specific groups in the Periodic Table of Elements as diluents for the monopropellant. This group of elements are well known by their atomic structure wherein the outer shell of valence electrons is considered full making these elements unlikely to participate in chemical reactions. These elements are often referred to as noble gases as the often are found as monatomic gases. These elements in Group 8 of the Periodic Table are helium, neon, argon, krypton, xenon, radon, and possibly other yet to be confirmed elements like ununoctium.

This method further teaches the use of monopropellant fluids comprising inert gases, noble gases, and ambient air as diluents for the monopropellant. This method further teaches the use of monopropellant fluids comprising methane and natural gas as fuels. This method further teaches the use of monopropellant fluids comprising air as an oxidizer and as a diluents.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of constructing a well apparatus for recovery of hydrocarbons from a subterranean reservoir fluidly coupled to a wellbore of said apparatus, said method comprising:

providing a reservoir for a composition comprising a monopropellant, said composition substantially free of hydrogen peroxide, hydrazine, or Otto Fuel;

inserting from surface, with a coiled tubing injector head, a first conduit into said wellbore, said first conduit having a proximal end at surface and a distal end below said surface, said first conduit fluidly coupled to said monopropellant composition reservoir;

engaging, at surface, said first conduit with said coiled tubing injector head;

connecting a catalytic reaction chamber at a point along the length of said first conduit, said reaction chamber having intake and exhaust fluid ports fluidly coupled to said first conduit, said catalytic reaction chamber having a catalyst composition disposed in it; and, attaching a check valve on said first conduit or on said catalytic reaction chamber, wherein said check valve is:

disposed on said catalytic reaction chamber at a position downstream from said catalyst composition in said reaction chamber, or, disposed on said first conduit at a location closer to said distal end of said first conduit than the location of said reaction chamber.

2. The method of claim 1, wherein said step of providing a catalytic reaction chamber at a point along the length of said first conduit, comprises providing a catalytic reaction chamber at or above surface.

3. The method of claim 1, wherein said first conduit is a continuous coiled tubing.

4. The method of claim 1, further comprising the step of providing a second conduit in said wellbore.

5. The method of claim 4, wherein said first conduit is a continuous coiled tubing and is disposed in said wellbore concentrically through said wellhead and said second conduit.

6. The method of 4, wherein said first conduit is disposed on the outside diameter of said second conduit.

7. The method of claim 4, further comprising the step of fluidly coupling said first conduit to at least one side pocket assembly and having said catalytic reaction chamber disposed in said side pocket, and fluidly coupling said side pocket to said second conduit.

8. The method of claim 4, further comprising the step of retrieving to surface through said second conduit said catalytic reaction chambers.

9. The method of claim 1, further comprising the step of moving said first conduit and said reaction chamber through said wellbore and simultaneously injecting said monopropellant composition from surface through said reaction chamber, across said catalyst, through said reactor exhaust port, through said check valve, and into said wellbore.

10. A method of recovering hydrocarbons from a subterranean reservoir fluidly coupled to a wellbore, said method comprising:

introducing a composition comprising a monopropellant into a first conduit, said first conduit extending into said wellbore having a proximal end at surface and a distal end below said surface in said wellbore, said first conduit fluidly coupled to a catalytic reaction chamber, said first conduit having a check valve disposed on it or disposed on said first conduit between said distal end and said reaction chamber, said composition substantially free of hydrogen peroxide, hydrazine, or Otto Fuel;

flowing said composition comprising a monopropellant into said catalytic reaction chamber through said first conduit;

conducting catalytic reaction products and/or heat formed by said step of flowing said composition comprising a monopropellant into said catalytic reaction chamber, said step of conduction comprises conducting said reaction products and/or heat into said wellbore or into said subterranean reservoir, or into both said wellbore and said subterranean reservoir; and, flowing reservoir fluids from said subterranean reservoir through a well.

11. The method of claim 10, wherein said step of conducting comprises conducting said catalytic reaction products and/or heat into said subterranean reservoir.

12. The method of claim 10, further comprising the step of moving said first conduit and said reaction chamber through said wellbore while simultaneously injecting said monopropellant composition from surface.

13. A method of recovering hydrocarbons from a subterranean reservoir comprising:

introducing a first composition comprising a monopropellant into a first conduit, said first conduit extending into a wellbore, said first conduit having a proximal end at surface and a distal end below said surface in said wellbore, said first conduit fluidly coupled to a catalytic reaction chamber, said first conduit having a check valve disposed on it or disposed on said first conduit between said distal end and said reaction chamber, said check valve being fluidly coupled to said first conduit and said reaction chamber, said first composition substantially free of hydrogen peroxide, hydrazine, or Otto Fuel;

flowing said first composition into said catalytic reaction chamber through said first conduit;

simultaneously flowing a second composition down a second conduit extending into said wellbore, said second composition substantially free of an oxidizer component;

heating said second composition with heat generated from said step of flowing said first composition into said catalytic reaction chamber, to form a heated second composition;

introducing at least said heat with said second composition into said subterranean reservoir; and, producing reservoir fluids from said subterranean reservoir to surface through a well.

14. The method of claim 13, wherein said second composition comprises a micro-emulsion.

15. The method of claim 13, further comprising the step of injecting said heated second composition into at least one injection well reservoir and producing it to surface from at least one separate production well reservoir.

16. The method of claim 13, wherein the injected heated second composition comprises a supercritical state as it enters said subterranean reservoir.

17. The method of claim 13, wherein said first composition comprising a monopropellant comprises a cryogenic fluid.

18. The method of claim 13, wherein said second composition comprises an alkane.

19. The method of claim 13, wherein said second composition comprises ammonia.

20. The method of claim 13, wherein at least a portion of said second composition is recovered at surface, separated from well fluids, and re-cycled and re-injected into a wellbore.

21. The method of claim 13, wherein said second composition comprises water.

22. The method of claim 13, wherein said first composition comprises propane and oxygen.

23. The method of claim 13, wherein said first composition comprises hydrogen and oxygen.

24. The method of claim 13, wherein said first composition comprises nitrogen.

25. The method of claim 13, wherein the heated second fluid is injected at a pressure above the fracture gradient of said reservoir.

26. A well apparatus for the recovery of hydrocarbons, said apparatus comprising:

a wellbore extending from surface to a subterranean region and fluidly coupled to a subterranean hydrocarbon-containing reservoir, a first conduit disposed, at least in part, in said wellbore, said first conduit engaged with a coiled tubing injector head, said first conduit having proximal end at surface and a distal end below said surface in said wellbore;

a catalytic reaction chamber disposed at a point along the length of said first conduit, said reaction chamber having intake and exhaust fluid ports fluidly coupled to said first conduit, said catalytic reaction chamber having a catalyst composition disposed in it;

a check valve fluidly coupled to said first conduit, said check valve being disposed on:

said catalytic reaction chamber, in a position downstream said catalyst composition of said reaction chamber, or, said first conduit at a location closer to said distal end of said first conduit than the location of said reaction chamber.

27. The apparatus of claim 26, further comprising a second conduit, said second conduit fluidly coupled to said subterranean hydrocarbon-containing reservoir.

* * * * *